US007391431B2

(12) United States Patent
Ohkawara et al.

(10) Patent No.: US 7,391,431 B2
(45) Date of Patent: Jun. 24, 2008

(54) IMAGE FORMING APPARATUS FOR CORRECTING MAGNIFICATION OF IMAGE

(75) Inventors: Hisakazu Ohkawara, Tokyo (JP); Hidenori Akamatsu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 464 days.

(21) Appl. No.: 11/222,797

(22) Filed: Sep. 12, 2005

(65) Prior Publication Data

US 2006/0055902 A1 Mar. 16, 2006

(30) Foreign Application Priority Data

Sep. 16, 2004 (JP) ..... 2004-270049

(51) Int. Cl.
*B41J 2/435* (2006.01)
*B41J 2/47* (2006.01)

(52) U.S. Cl. ..... 347/235; 347/250

(58) Field of Classification Search ..... 347/234–235, 347/248–250

See application file for complete search history.

(56) References Cited

U.S. PATENT DOCUMENTS 5,610,651 A * 3/1997 Yamakawa et al. ..... 347/250
6,157,400 A 12/2000 Genovese
6,219,085 B1 4/2001 Hanna
6,236,418 B1 5/2001 Yamakawa
6,459,520 B1 10/2002 Takayama
6,833,856 B2 * 12/2004 Maeda ..... 347/248
6,933,957 B2 * 8/2005 Omori et al. ..... 347/249
7,050,080 B2 * 5/2006 Ema et al. ..... 347/235
2003/0067533 A1 4/2003 Omori et al.
2006/0055902 A1 3/2006 Ohkawara et al.

FOREIGN PATENT DOCUMENTS

JP 2003-279873 10/2003

OTHER PUBLICATIONS

U.S. Appl. No. 11/083,158, filed Mar. 18, 2005, Hisakazu Ohkawara, et al.
U.S. Appl. No. 11/443,063, filed May 31, 2006, Akamatsu.
John C. Mallinson, "Frequency Modulation in Video Tape Recorders", IEEE Transactions on Magnetics, vol. 34 No. 6, XP011032099, Nov. 1998, pp. 3916-3921.

* cited by examiner

*Primary Examiner*—Hai C Pham
(74) *Attorney, Agent, or Firm*—Oblon, Spivak, McClelland, Maier & Neustadt, P.C.

(57) ABSTRACT

A measuring unit measures a time difference between detections of the optical beams by an optical beam detector arranged on either side of an image carrier with respect to a horizontal scanning direction. A magnification correcting unit determines whether a beam spot position adjustment amount corresponding to each of a plurality of developing colors preset by the sub position correcting unit exceeds a threshold preset for each of the plurality of developing colors, and depending on the result of the determination, performs magnification correction of the image by changing a beam spot position interval on a scanning line in units of a line or lines, or by changing a beam spot position interval on a scanning line in units of pixel.

6 Claims, 13 Drawing Sheets

IMAGE FORMING APPARATUS FOR CORRECTING MAGNIFICATION OF IMAGE

CROSS-REFERENCE TO RELATED APPLICATIONS

The present document incorporates by reference the entire contents of Japanese priority document, 2004-270049 filed in Japan on Sep. 16, 2004.

BACKGROUND OF THE INVENTION

1. Field of the Invention

The present invention relates to an image forming apparatus.

2. Description of the Related Art

In laser printers, which are image forming apparatuses, a photoconductor, which is an image carrier, is scanned in a horizontal scanning direction (i.e., main scanning direction) by optical beams (laser beams) deflected by a deflector to write an image on the surface of the photoconductor. The deflector can be, for example, a rotating polygon mirror.

Optical beams are deflected at an isometric velocity in the horizontal scanning direction by the deflector, and the optical beams are corrected from deflection at the isometric velocity to deflection at a uniform velocity by a fθ lens.

The fθ lenses can be made from different material including plastic. However, if an fθ lens made of plastic is used, its shape and/or refractive index can change with the surrounding temperature. If the shape or the refractive index changes, a scanning position on the photoconductor deviates, which results in a magnification error in the horizontal scanning direction. The magnification error leads to a degraded image. The refractive index also changes with the wavelength of the laser beam.

Various technologies have been proposed to correct the magnification error. In one approach, laser beams scanned in the horizontal scanning direction are respectively detected by laser beam detectors provided at two positions in the horizontal scanning direction, the time difference between detections of the laser beams in the two detectors is measured, and the magnification in the horizontal scanning direction is corrected based on this time difference.

Laser printers are disclosed in Japanese Patent Application Laid-open No. 2003-279873. In one of these laser printers, a scanning target surface is scanned in the horizontal scanning direction by beams of light deflected by a deflector, the beams of light are respectively detected on a write start position side and a write end position side, to correct the phase data based on the fluctuation amount of time required for scanning between the two positions, and the phase of respective signals of an image clock that performs image formation based on the phase data is shifted (phase modulation), thereby correcting the magnification of the image in the horizontal scanning direction on the image carrier.

In other laser printer disclosed in Japanese Patent Application Laid-open No. 2003-279873, the whole misregistration of dots in the horizontal scanning direction is shifted by changing the frequency of the image clock (frequency modulation), to correct the magnification of the image in the horizontal scanning direction on the image carrier.

The laser printer that corrects the magnification of the image by phase modulation in which the phase of the image clock signal is shifted can change the correction amount in a short period of time, and hence, correction can be performed in between sheets of paper (at the timing when image formation is not performed), when images are continuously formed.

However, since image degradation occurs more or less as compared with the magnification correction of the image by frequency modulation, there is a problem in that when the phase shift amount of the image clock signal increases, degradation in the formed image increases.

On the other hand, when magnification correction of the image is performed by frequency modulation in which the whole misregistration amount of dots is shifted, a better image can be obtained as compared to the one obtained by phase modulation. In the case of frequency modulation, however, a phase-locked loop (PLL) circuit is normally used for generating a pixel clock for modulating the laser beams corresponding to an image signal. The PLL circuit includes a voltage-controlled oscillator that changes the frequency according to the applied voltage, and it is necessary to stop the printing operation until the PLL oscillating frequency is stabilized after having started a change in the oscillating frequency of the PLL.

That is, in the case of a method of correcting the frequency of the image signal, for example, number of prints and time are counted, and magnification correction of the image by frequency modulation is performed at an interval of certain time that is considered not to cause a side effect such as image degradation. In this case, however, image forming operation is suspended in order to correct the frequency of the image signal. As a result, the number of suspensions increases, and the overall print speed (number of image formations per unit time) as an image forming apparatus decreases drastically.

Further, when magnification correction of an image is performed by frequency modulation, if the timing for performing the frequency correction is previously set, then even when the magnification error in the horizontal scanning direction increases in the period after frequency correction of the image signal until the next frequency correction is performed, frequency correction is not performed until the timing for the next frequency correction, and hence, a degraded image is formed during this time.

SUMMARY OF THE INVENTION

It is an object of the present invention to at least solve the problems in the conventional technology.

According to an embodiment of the present invention, an image forming apparatus includes a deflector configured to deflect optical beams modulated according to an image signal to thereby scan a surface of an image carrier in a horizontal scanning direction to form an image on the image carrier; an optical beam detector arranged on either side of the image carrier along the horizontal scanning direction, wherein the optical beam detectors are configured to detect an optical beams deflected by the deflector; a time difference measuring unit configured to measure a time difference between detections of the optical beams by optical beam detectors; and a magnification correcting unit configured to correct, based on the time difference, a magnification in the horizontal scanning direction of the image on the image carrier. The magnification correcting unit includes a main position correcting unit configured to perform magnification correction of the image by changing a beam spot position interval on a scanning line in units of a line or lines; a sub position correcting unit configured to perform magnification correction of the image by changing a beam spot position interval on a scanning line in units of pixel; and a position adjustment amount-determining unit that determines whether a beam spot position adjustment amount corresponding to each of a plurality of developing colors preset by the sub position correcting unit exceeds a threshold preset for each of the plurality of developing colors, wherein the magnification correction of the image by the sub position correcting unit is changed over to the magnification correction of the image by the main position correcting unit based on a determination result of the position adjustment amount-determining unit.

According to another embodiment of the present invention, an image forming apparatus includes a deflector configured to deflect optical beams modulated according to an image signal to thereby scan a surface of an image carrier in a horizontal scanning direction to form an image on the image carrier; an optical beam detector arranged on either side of the image carrier along the horizontal scanning direction, wherein the optical beam detectors are configured to detect an optical beams deflected by the deflector; a time difference measuring unit configured to measure a time difference between detections of the optical beams by optical beam detectors; and a magnification correcting unit configured to correct, based on the time difference, a magnification in the horizontal scanning direction of the image on the image carrier. The magnification correcting unit includes a main position correcting unit configured to perform magnification correction of the image by changing a beam spot position interval on a scanning line in units of a line or lines; a sub position correcting unit configured to perform magnification correction of the image by changing a beam spot position interval on a scanning line in units of pixel; and a position adjustment amount-determining unit that determines whether a beam spot position adjustment amount by the sub position correcting unit, in a predetermined region in the horizontal scanning direction set for each of a plurality of colors, exceeds a threshold preset for each of the colors, wherein the magnification correction of the image by the sub position correcting unit is changed over to the magnification correction of the image by the main position correcting unit based on a determination result of the position adjustment amount-determining unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
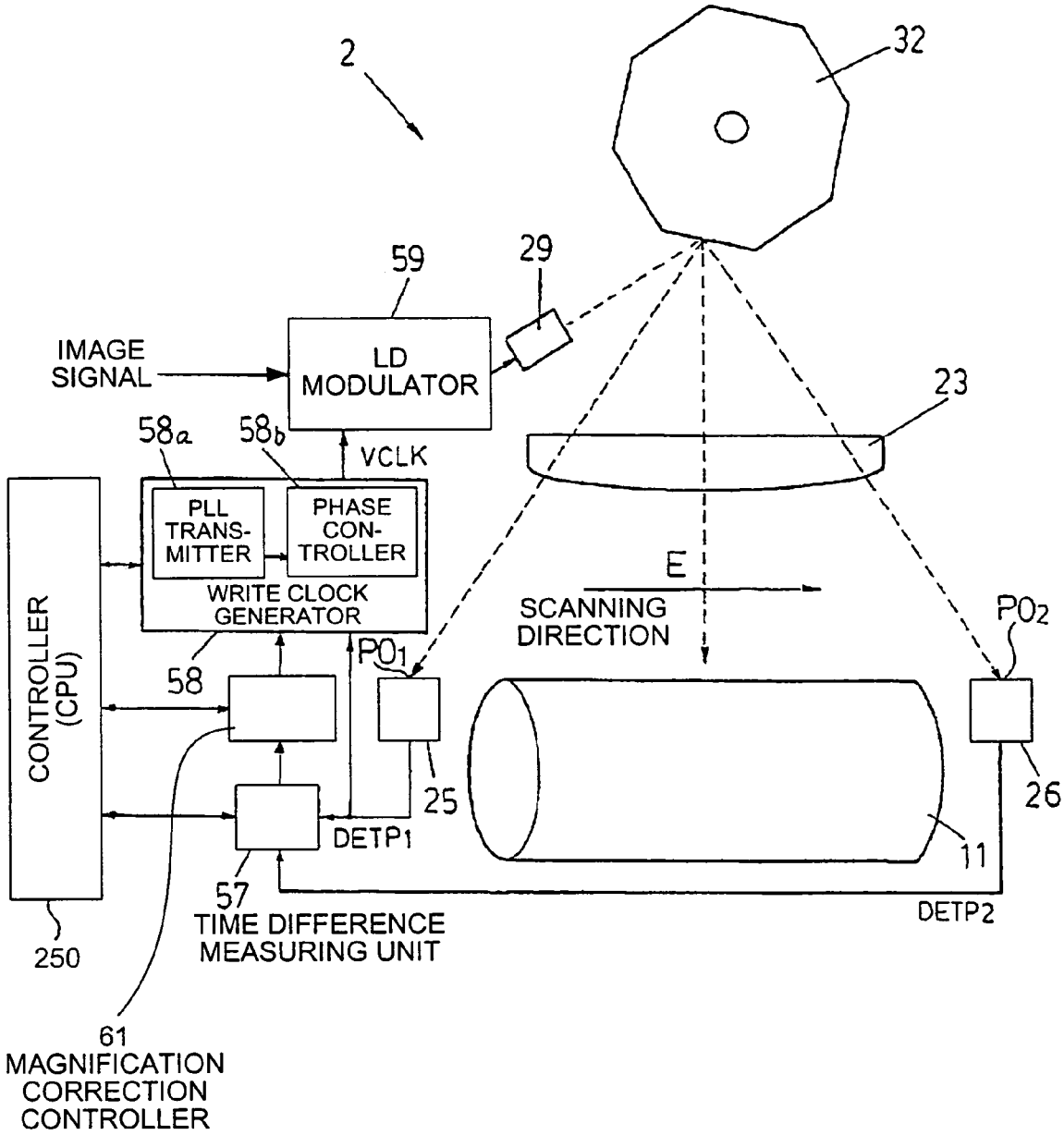
FIG. 1 is a schematic diagram of relevant parts of an optical scanner and a photoconductor together with an associated control system of an image forming apparatus according to a first embodiment of the present invention.
Figure 2:
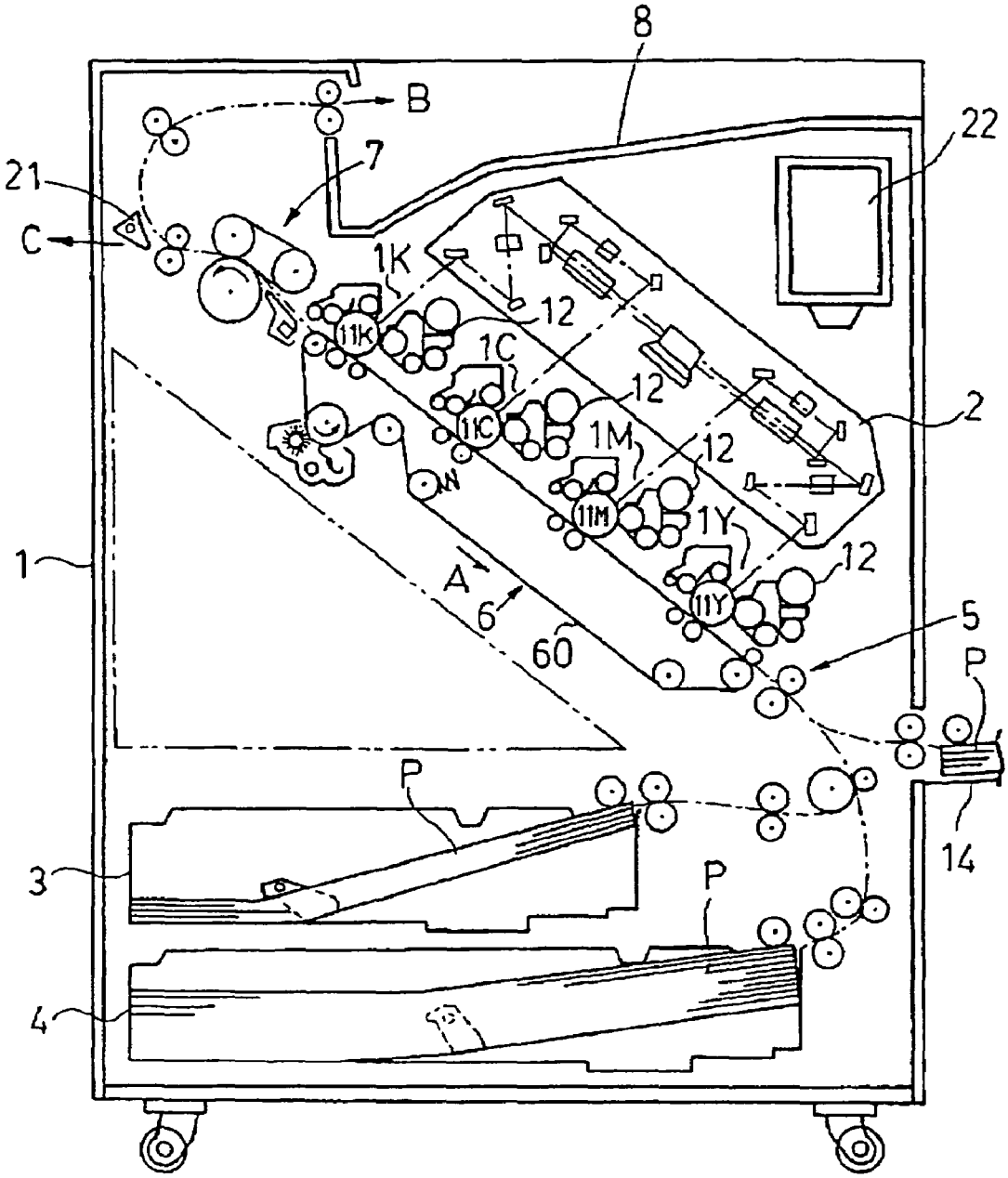
FIG. 2 depicts an internal structure of a laser printer that is an example of the image forming apparatus.

FIG. 1 is a schematic diagram of relevant parts of an optical scanner and a photoconductor together with an associated control system of an image forming apparatus according to a first embodiment of the present invention. FIG. 2 depicts an internal structure of a laser printer as an example of the image forming apparatus.

The laser printer includes an optical scanner 2. As shown in FIG. 1, the optical scanner 2 includes a polygon mirror 32, a photoconductor 11, sensors 25 and 26, a time difference measuring unit 57, a magnification correction controller 61, and a write clock generator 58. The polygon mirror 32 functions as a deflector that deflects optical beams modulated based on an image signal in the horizontal scanning direction thereby scanning the photoconductor 11 with the optical beams and forming an image on the photoconductor 11. The sensors 25 and 26 are situated on positions $PO_1$ and $PO_2$ along the horizontal scanning direction on either side of the photoconductor 11 and function as optical beam detectors that respectively detect optical beams deflected by the polygon mirror 32. The time difference measuring unit 57 measures the time difference between when the sensor 25 detects the optical beam until when the sensor 26 detects the optical beam. The magnification correction controller 61 functions as a magnification correcting unit that corrects magnification of the image on the photoconductor 11 in the horizontal scanning direction based on the time difference measured by the time difference measuring unit 57. The write clock generator 58 generates a write clock VCLK.

The write clock generator 58 includes a PLL transmitter 58*a* and the phase controller 58*b*. The PLL transmitter 58*a* functions as a main position correcting unit (horizontal position correcting unit) that performs magnification correction of an image on the photoconductor 11 by changing a beam spot position interval on a scanning line in the unit of a line or in the unit of a plurality of lines. The phase controller 58*b* functions as a sub position correcting unit that performs magnification correction of an image by changing a beam spot position interval on a scanning line in the unit of pixel.

In the first embodiment, the magnification correction controller 61 also functions as a main position correcting unit and a sub position correcting unit.

The magnification correction controller 61 functions as a position adjustment amount-determining unit that determines the magnitude correlation between a beam spot position adjustment amount corresponding to each of a plurality of developing colors set by the sub position correcting unit (PLL transmitter 58*a*) and a threshold set for each of the developing colors. Further, the laser printer causes a controller 250, which is a microcomputer, to control so as to change over from the magnification correction of an image by the sub position correcting unit (phase controller 58*b*) to the magnification correction of the image by the main position correcting unit.

The laser printer shown in FIG. 2 forms images by using an electrographic method. The configuration for forming images using the electrographic method is shown in FIG. 2. In other words, the laser printer includes photosensitive drums 11Y, 11M, 11C, and 11K (hereinafter, simply as the photoconductor(s) 11, unless otherwise specified) that functions as image carriers on which an image of respective colors of yellow (Y), magenta (M), cyan (C), and black (B), are formed. The photosensitive drums 11Y, 11M, 11C, and 11K are situated with a space therebetween along the direction shown by an arrow A. A belt drive 6 drives and moves a transfer carrier belt 60 in the direction shown by the arrow A. A development unit 12 is provided corresponding to each of the four photoconductors 11.

The optical scanner 2 is situated above the four photoconductors 11. Paper feed cassettes 3 and 4 are provided in the lower part of an apparatus body 1 of the laser printer, and a pair of resist rollers 5 and the belt drive 6 are also provided. The belt drive 6, in the state with transfer paper (sheet) P carried thereon, sequentially carries the transfer paper P to toner image forming units (1Y, 1M, 1C, and 1K) where the photoconductors 11 are respectively provided, and carries the transfer paper P to a fixing unit 7. In the first embodiment, the belt drive 6 functions as a transfer unit.

Further, the laser printer includes a paper ejection tray 8, a manual feed tray 14, a toner supply container 22, and the like.

The transfer paper P is carried on a transport route shown by one-dot chain line in FIG. 2, an image is formed thereon, and the transfer paper P is ejected on the paper ejection tray 8.

When starting the image forming operation, the transfer paper P fed from the paper feed cassettes 3, 4, or the manual feed tray 14 is carried to the resist rollers 5, while being guided by a transport guide plate and stopped there temporarily.

The resist rollers 5 rotate at a predetermined timing. As a result, the resist rollers 5 carry the transfer paper P onto the transfer carrier belt 60. The transfer paper P gets electrostatically attracted onto the belt surface. The transfer paper P is then carried to the toner image forming unit, where the photoconductor 11 is present, by the transfer carrier belt 60 that is rotating in the direction shown by the arrow A.

Toner images of the respective colors formed on the respective photosensitive drums 11Y, 11M, 11C, and 11K are sequentially transferred and superposed on the transfer paper P by an action of transfer electric field and a nip pressure in the toner image forming unit. Accordingly, a full colored toner image is formed on the transfer paper P.

After the toner image is transferred onto the transfer paper P, the surfaces of the photosensitive drums 11Y, 11M, 11C, and 11K are cleaned by respective cleaning units and the electricity is removed therefrom. Thus, the photosensitive drums 11Y, 11M, 11C, and 11K become ready for formation of next image.

The fixing unit 7 fixes the full-color toner image onto the transfer paper P. The transfer paper P with the fixed full-color toner image is then carried in a first paper ejection direction shown by an arrow B or a second paper ejection direction shown by an arrow C. In which direction the transfer paper P is carried depends on a switching position of a switching guide 21.

When the transfer paper P is carried in the first paper ejection direction and ejected onto the paper ejection tray 8, the transfer paper P is ejected in the paper ejection tray 8 in a so-called face down state, with the image surface facing down. When the transfer paper P is carried in the second paper ejection direction, the transfer paper P is carried toward a post-processor (not shown). The post-processor can be a sorter, a stapler, or the like.

In the optical scanner 2, a laser diode (LD) 29 that functions as an optical beam generator emits optical beams (laser beams) equivalent of image signals. Although not shown in the drawings, the optical beams pass through a collimate lens and a cylindrical lens, and finally fall on the rotating polygon mirror 32. The polygon mirror 32 deflects the optical beams so that optical beams pass through an fθ lens 23 and a toroidal lens (hereinafter, "BTL") (not shown), and fall on the photoconductor 11. As the polygon mirror 32 rotates, the photoconductor 11 is scanned in the scanning direction with the optical beams. The BTL performs focusing mainly in a vertical scanning direction (i.e., sub scanning direction), that is, performs condensing function and position correction (cross-scan error compensation and the like) in the vertical scanning direction.

In FIG. 1, only one of the four photoconductors 11 is shown. The other three photoconductors and corresponding optical scanners have the same configuration, with only the color of an image to be formed being different, and hence the illustration thereof is omitted.

A driving unit, a motor, for example, rotates the polygon mirror 32. The fθ lens mainly performs velocity transformation. In other words, when optical beams of an isometric velocity that are deflected from the polygon mirror 32 enter into the fθ lens 23, they are converted into optical beams of a constant velocity.

When an optical beam scans the photoconductor 11, the optical beam first falls on the sensor 25, scans the photoconductor 11 in the direction shown by an arrow E, and finally falls on the sensor 26. Thus, there is a time lag, or a time difference, between when the optical beam falls on and it is detected in the sensor 25 and when the optical beam falls on and it is detected in the sensor 26. The sensor 25 also serves as a synchronism detection sensor for detecting a laser beam-scanning synchronization signal, which becomes a synchronism detection signal.

When an optical beam is detected, the sensor 25 outputs a laser beam detection signal DETP1, and the sensor 26 outputs a laser beam detection signal DETP2. The laser beam detection signals DETP1 and DETP2 are transmitted to the time difference measuring unit 57. The time difference measuring unit 57 measures a difference between the time of arrival of the laser beam detection signals DETP1 and DETP2. As the polygon mirror 32 rotates, the laser beam detection signals DETP1 and DETP2 arrive one after the other. The time difference measuring unit 57 calculates an average of a plurality of measured times as a time difference. The time difference measuring unit 57 measures the time of arrival of the laser beam detection signals DETP1 and DETP2 by using timing set by the controller (CPU) 250. The time difference measuring unit 57 transmits the time difference to the magnification correction controller 61.

The magnification correction controller 61 includes a storage unit that stores initial set values and current set values of the set write clock frequency and phase shift value which is indicative of beam spot position amount. The controller 250 sends the initial set values and the current set values to the magnification correction controller 61. The magnification correction controller 61 calculates the phase shift value when an optimum write clock frequency is set, by using the fact that the image magnification in the horizontal scanning direction is changed by the frequency of the write clock, and by using the fact that the image magnification is changed by shifting the phase in the case of such a short time that cannot be adjusted by adjusting a write clock.

The write clock generator 58 includes a PLL transmitter 58*a* and a phase controller 58*b*. The PLL transmitter 58*a* generates a clock n times as large as a write clock VCLK upon reception of a clock from an oscillator (not shown). The phase controller 58*b* divides the frequency of a PLL transmission clock by n, synchronized with the laser beam detection signal DETP1 as a synchronism detection signal to generate the write clock VCLK synchronized with the laser beam detection signal DETP1 and having a function of shifting (changing) the write clock cycle time of an optional pixel in the unit of pixel by adding or subtracting an integral multiple of the half cycle of the PLL transmission clock to or from a special cycle of the write clock.

In FIG. 1, only one image writing unit has been shown; however, the image forming apparatus includes plural image writing units depending on color. For example, as shown in FIG. 2, the image forming apparatus can include four image writing units, i.e, one image writing unit for each developing colors of yellow (Y), magenta (M), cyan (C), and black (B). The configuration shown in FIG. 2 assumes that one polygon mirror 32 is shared by the four image writing units; however, one polygon mirror can be provided for each image writing unit. The write clock generator 58 generates the write clock VCLK and executes the phase shift under control of the magnification correction controller 61.

The write clock VCLK subjected to the image magnification correction in the horizontal scanning due to changeability of the write clock frequency and the phase shift value by the write clock generator 58 is transmitted to the LD modulator 59 that functions as the optical beam generator actuator.

The LD modulator 59 controls lighting of the laser diode 29 in the LD unit according to the image signal synchronized with the write clock PCLK from the write clock generator 58. Accordingly, laser beams modulated according to the image signal are emitted from the laser diode 29, and the laser beams are deflected by the rotating polygon mirror 32 to scan across the photoconductor 11 via the fθ lens 23 in the direction of the arrow E in FIG. 1.

In FIG. 1, the write clock generator 58, the time difference measuring unit 57, and the magnification correction controller 61 are shown as separate units; however, they can be combined into one write clock generator.

The controller 250 can communicate with storage units that store comparison determination results in the image writing units through serial communications, and can simultaneously monitor determination results of comparing the phase shift value (beam spot position adjustment amount) with the threshold.

The magnification correction of an image performed by the control system in the image forming apparatus according to the first embodiment will be explained below with reference to FIG. 3.

Figure 3:
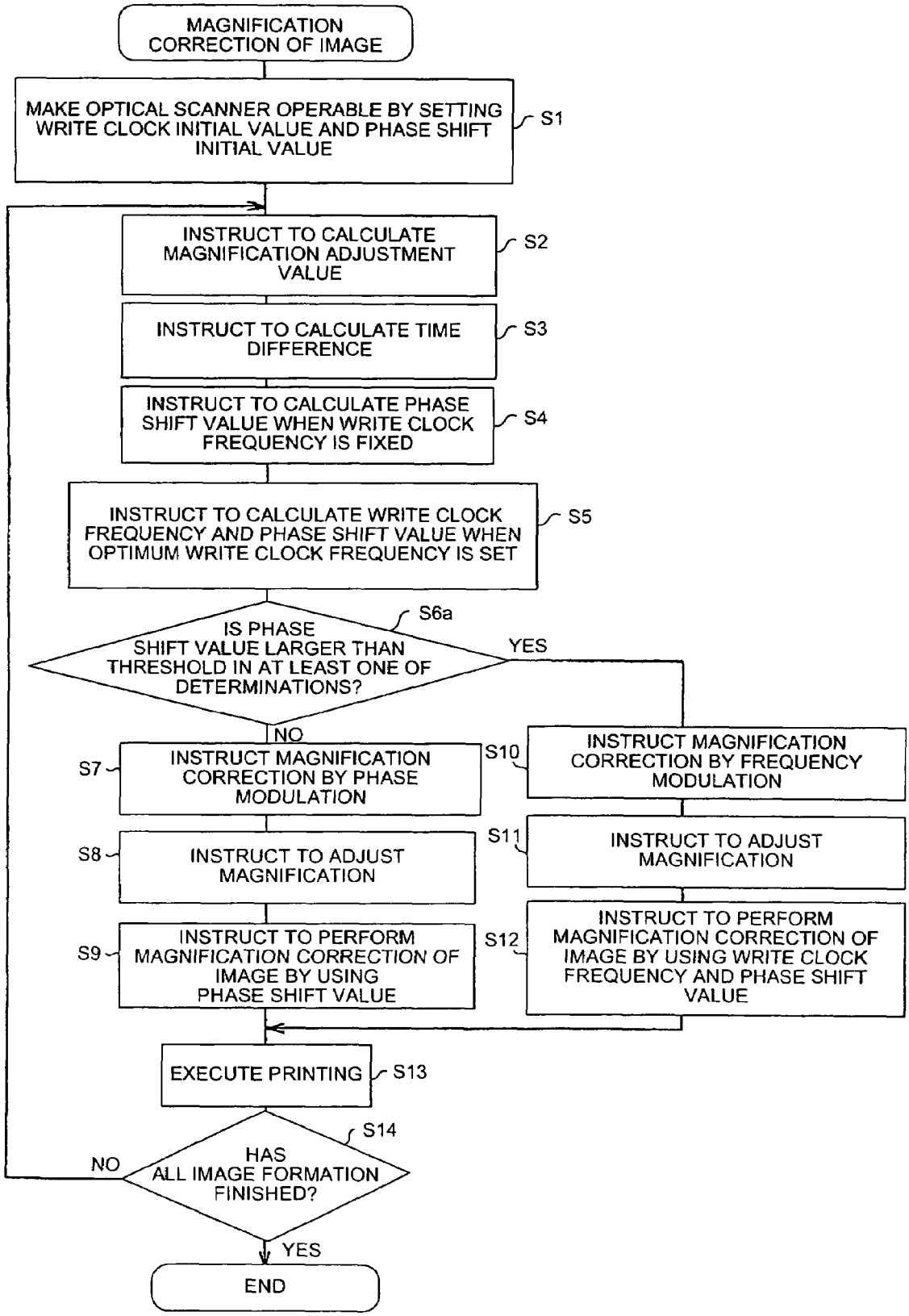
FIG. 3 is a flowchart of a process procedure for a magnification correction of an image performed by the control system in the image forming apparatus according to the first embodiment.

When the routine in FIG. 3 is started, at step S1, the controller 250 sets a write clock initial value and a phase shift initial value in the magnification correction controller 61 at a predetermined timing such as after turning the power on or restarting after having stopped the machine, and makes the optical scanner printable corresponding to the set write clock initial value and phase shift initial value. In this state, since the printing is possible, printing can be performed.

At next step S2, at the timing when the polygon mirror 32 is rotating between sheets or during printing, and when the laser diode 29 is in the state capable of lighting, the controller 250 outputs an instruction to calculate a magnification adjustment value to the time difference measuring unit 57 and the magnification correction controller 61, respectively.

At step S3, the controller 250 allows the time difference measuring unit 57 to measure the time difference since the sensor 25 has detected the laser beam at specified timing until the sensor 26 detects the laser beam for the specified number of measurements, to calculate a mean value of the measurement result. As a result, the time difference measuring unit 57 outputs the mean value or the like of the measurement result of the time difference to the magnification correction controller 61.

The measurement of the time difference is performed for each of the image writing units which handle the four developing colors, respectively.

At next step S4, the controller 250 allows the magnification correction controller 61 to calculate a phase shift value (beam spot position adjustment amount corresponding to each of the four developing colors) when the write clock frequency is fixed, from the mean value or the like of the measurement result of the time difference. At step S5, substantially at the same timing as at step S4 in parallel, the controller 250 allows the magnification correction controller 61 to calculate a write clock frequency (write clock value) and a phase shift value when an optimum write clock frequency is set, from the mean value or the like of the measurement result of the time difference.

At step S6*a*, the controller 250 determines the magnitude correlation between the phase shift value (beam spot position adjustment amount) calculated for each of the four developing colors at step S4 and the threshold preset in the controller 250. That is, the controller 250 determines whether the phase shift value is larger than the threshold for each image writing unit corresponding to each developing color to determine whether the phase shift value is larger than the threshold in at least one of the determinations corresponding to the four developing colors (another way to determine the magnitude correlation is explained later), and stores the comparison result (magnitude correlation) in the storage unit.

According to the determinations corresponding to the four developing colors, when the phase shift value is larger than the threshold in at least one of the determinations, control proceeds to step S10. When all the phase shift values corresponding to the four developing colors do not exceed respective thresholds (phase shift value≦threshold) (NO), at step S7, the controller 250 transmits the determination result such that magnification correction of an image (magnification correction of an image by the sub position correcting unit) is to be executed by phase modulation that can perform magnification correction of the image without expanding the interval between sheets even during continuous printing, to the write clock generator 58.

At step S8, the controller 250 issues a magnification adjustment instruction to the magnification correction controller 61 at the timing effective for printing after having calculated the phase shift value. Accordingly, the magnification correction controller 61 stores the instruction. At step S9, the magnification correction controller 61 transmits a control signal for performing the magnification correction of the image by using the determined phase shift value to the write clock generator 58. Accordingly, the magnification correction of the image is performed by changing the beam spot position interval on the scanning line in the unit of pixel.

According to the determination at step S6*a*, when the phase shift value is larger than the threshold in at least one of the determinations, and at least one of the phase shift values exceeds the threshold, control proceeds to step S10, where a determination result of magnification correction by the main position correcting unit (magnification correction by frequency modulation) is transmitted to the write clock generator 58. The main position correcting unit performs magnification correction of an image by changing the beam spot position interval on the scanning line in the unit of a line or in the unit of a plurality of lines.

The magnification correction by the frequency modulation cannot be performed at any timing during image formation, and a certain period of time is necessary for the magnification correction. Therefore, it is necessary to have an interval between sheets during continuous printing. Accordingly, continuous printing is temporarily suspended, and at step S11, a magnification adjustment instruction is sent to the magnification correction controller 61 at a convenient timing.

Accordingly, the magnification correction controller 61 stores the instruction. At step S12, the controller 250 allows the magnification correction controller 61 to transmit a control signal for performing the magnification correction of the image with optimum write clock frequency and phase shift value calculated at step S5 to the write clock generator 58. Accordingly, magnification correction of the image (magnification correction of the image by the main position correcting unit) is performed by the frequency modulation in which the frequency of the image signal is changed in the unit of a line or in the unit of a plurality of lines.

At step S13, printing is executed according to the control signal set and transmitted to the write clock generator 58 at step S9, or the control signal set and transmitted to the write clock generator 58 at step S12.

At step S14, it is determined whether the all set image formation has finished, and if the image formation has finished, the processing in this routine is finished. If all image formation has not finished yet, with returning to step S2, to repeat the processing and determination at step S2 and following steps at a predetermined timing.

Thus, in the image forming apparatus (laser printer) according to the first embodiment, the magnification correction of the image (magnification correction of an image by the sub position correcting unit) is performed by changing the beam spot position interval on the scanning line in the unit of pixel until at least one of the beam spot position adjustment amounts (phase shift values) corresponding to the four developing colors exceeds a preset threshold, and after at least the one thereof exceeds the preset threshold, magnification correction of the image (magnification correction of the image by the main position correcting unit) is performed by changing the beam spot position interval on the scanning line in the unit of line or in the unit of a plurality of lines.

Since the interval between sheets has to be enlarged in the latter case, it is necessary to suspend continuous printing. However, the execution times of magnification correction (frequency modulation) of an image by the main position correcting unit can be decreased. Therefore, productivity of image formation can be improved.

Furthermore, the threshold can be set to an optimum value for each developing color. Therefore, the changeover from the magnification correction of an image by the sub position correcting unit to the magnification correction of an image by the main position correcting unit can be performed at more appropriate timing.

Figure 4:
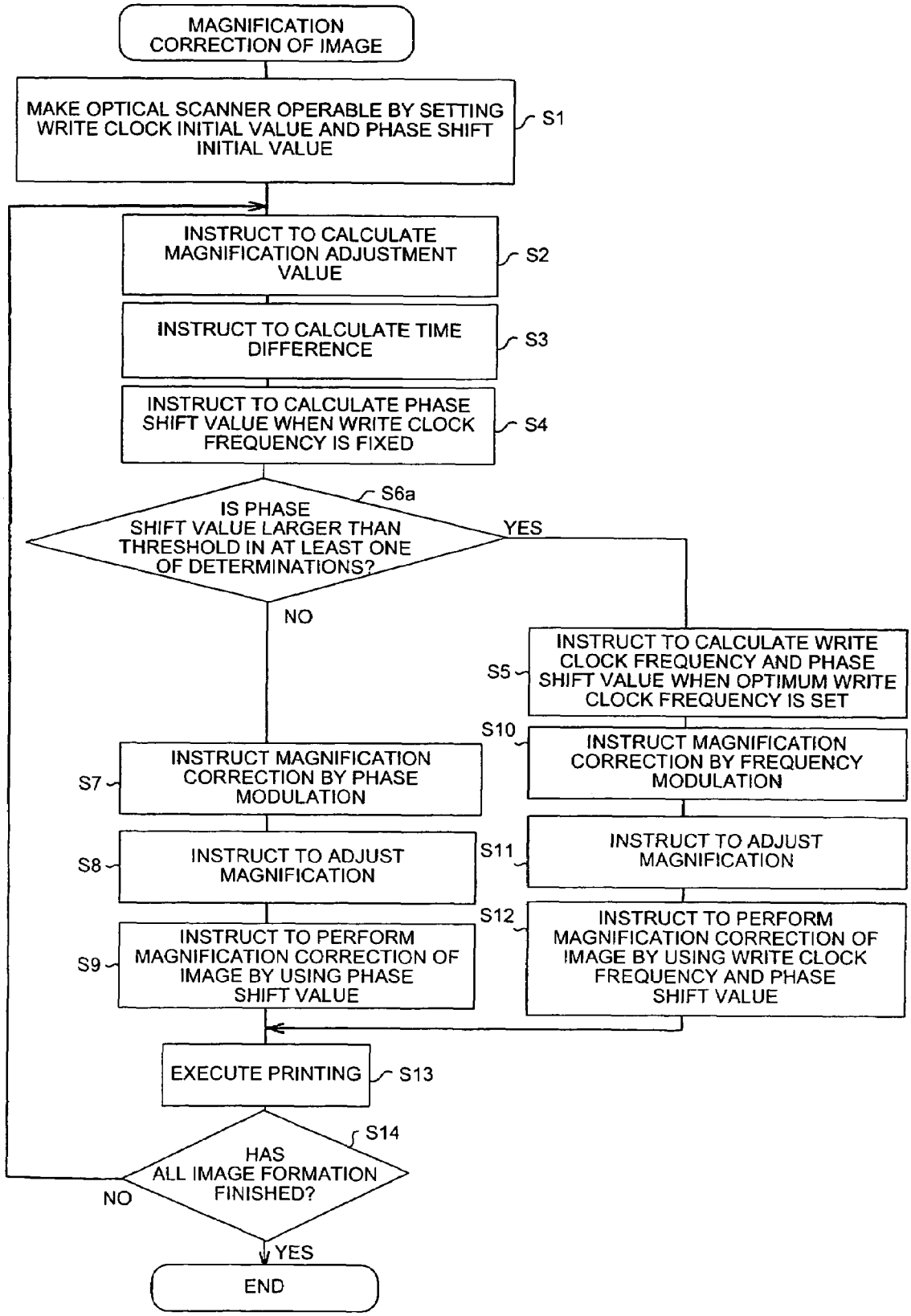
FIG. 4 is a flowchart of another routine for a magnification correction of an image performed by a control system in an image forming apparatus according to a second embodiment of the present invention.

FIG. 4 is a flowchart of a process procedure for the magnification correction of an image performed by a control system in an image forming apparatus according to a second embodiment of the present invention. The configuration of the image forming apparatus according to the second embodiment is the same as that in FIG. 2. Moreover, the configuration of the control system is the same as that in FIG. 1, but only the content of the control performed by the controller (CPU) is different. Therefore, the configuration of the image forming apparatus and the configuration of the control system are not shown herein, and the reference signs in FIG. 1 are used as necessary.

In the image forming apparatus according to the second embodiment, when the routine shown in FIG. 4 is started, the processing explained at steps S1 to S4 in FIG. 3 is respectively performed, so that the magnification correction controller 61 calculates a phase shift value (beam spot position adjustment amount) when the write clock is fixed, from a mean value or the like of the measurement result of the time difference measured at step S3.

Thereafter, control proceeds to step S6*a*, where the controller 250 determines the magnitude correlation between the phase shift value (beam spot position adjustment amount) calculated for each of the four developing colors at step S4 and the threshold preset in the controller 250, that is, whether the phase shift value is larger than the threshold for each of the image writing units corresponding to the developing colors. The controller 250 further determines whether the phase shift value is larger than the threshold in least one of the determinations corresponding to the four developing colors, and stores the comparison result (magnitude correlation) in the storage unit.

According to the determinations corresponding to the four developing colors, when the phase shift value is larger than the threshold in at least one of the determinations, control proceeds to step S5. When all the phase shift values corresponding to the four developing colors do not exceed respective thresholds (phase shift value≦threshold) (NO), at step S7, the controller 250 transmits the determination result such that magnification correction of an image is to be executed by phase modulation (magnification correction of an image by the sub position correcting unit), by which magnification correction of the image can be performed without expanding the interval between sheets even during continuous printing, to the write clock generator 58.

According to the determination at step S6*a*, when the phase shift value is larger than the threshold in at least one of the determinations, and at least one of the phase shift values exceeds the threshold, control proceeds to step S5, where the same processing as that explained at step S5 of FIG. 3, that is, the magnification correction controller 61 calculates a write clock value and a phase shift value (beam spot position adjustment amount) when an optimum write clock is set, from the mean value or the like of the measurement result of the time difference. Thereafter, the processing and determination the same as the content explained at step S10 and the following steps of FIG. 3 are performed.

That is, in the second embodiment, only when the phase shift value (beam spot position adjustment amount) at least one of the four developing colors when the write clock is fixed is larger than the threshold, the controller 250 allows the main position correcting unit to calculate the write clock value and the phase shift value when the optimum write clock frequency is set, that is, to perform magnification correction.

In this manner, the same effect as in the first embodiment can be obtained in the second embodiment.

Figure 5:
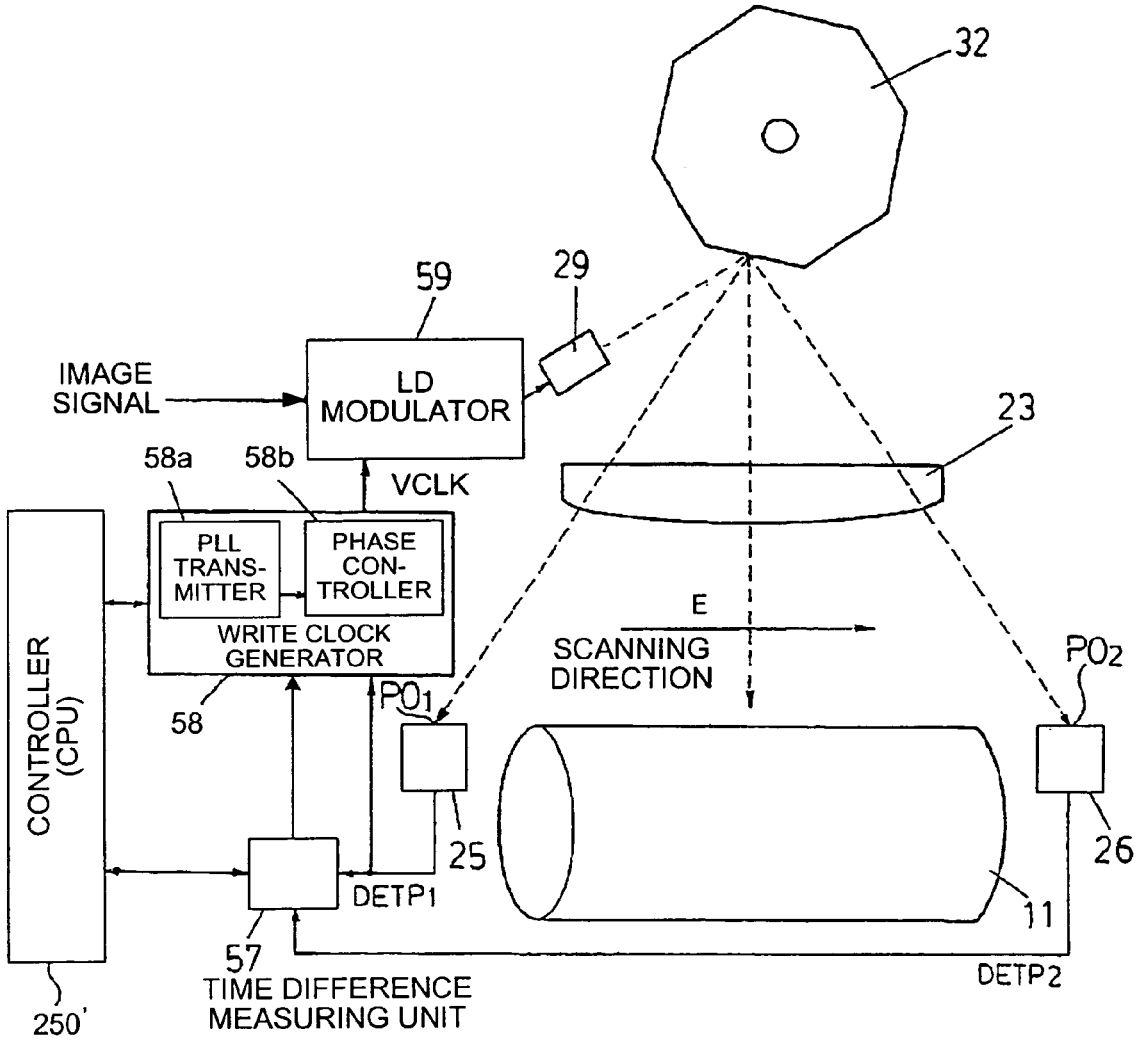
FIG. 5 is a schematic diagram of relevant parts of an optical scanner and a photoconductor together with an associated control system of an image forming apparatus according to a third embodiment of the present invention.
Figure 6:
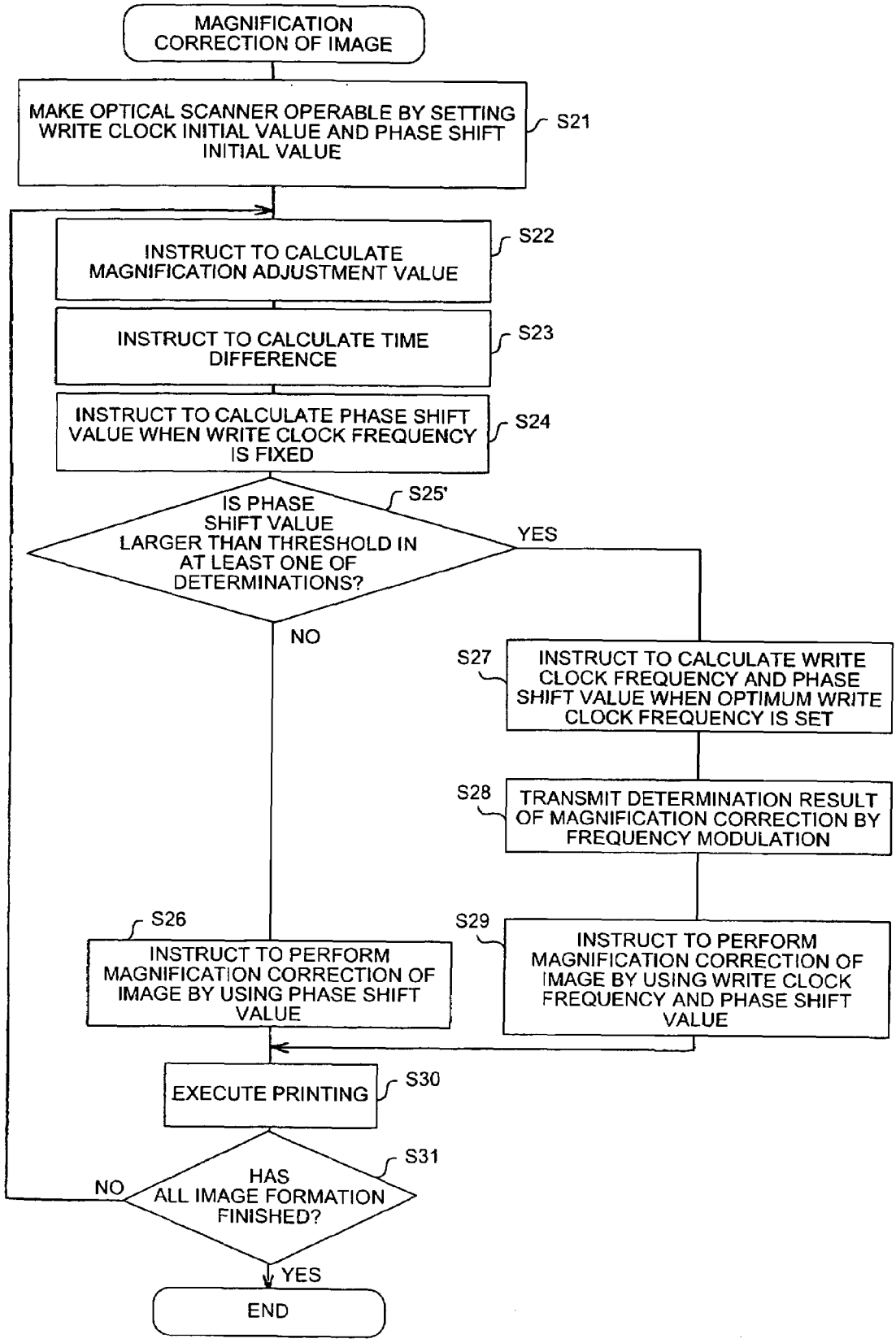
FIG. 6 is a flowchart of a process procedure for a magnification correction of an image performed by the control system in the image forming apparatus according to the third embodiment.

FIG. 5 is a schematic diagram of relevant parts of an optical scanner and a photoconductor together with an associated control system of an image forming apparatus according to a third embodiment of the present invention. FIG. 6 is a flowchart of a process procedure for a magnification correction of an image performed by the control system. In FIG. 5, the parts that are similar to those shown in FIG. 1 have been designated with like reference signs.

The configuration of the image forming apparatus according to the third embodiment is the same as that in FIG. 2.

The image forming apparatus according to the third embodiment is different from the image forming apparatus according to the first embodiment in that a controller (CPU) 250' performs the function of the magnification correction controller 61. The controller 250' includes a microcomputer similar to that of the controller 250, and only the content of the control is different from the controller 250.

In the third embodiment, the time difference measuring unit 57 performs time difference measurement and calculation between the laser beam detection signals DETP1 and DETP2, and transmits the measurement result and the calculation result to the controller 250'. The controller 250' has a storage unit that stores the initial set values and the current set values of the write clock frequency and the phase shift value (beam spot position adjustment amount), and has a function of calculating an optimum write clock frequency and a phase shift value by using the fact that the image magnification in the horizontal scanning direction is changed by the frequency of the optimum write clock, and by using the fact that the image magnification is changed by shifting the phase in the case of such a short time that cannot be adjusted by adjusting a write clock.

The controller 250' has a function of calculating the optimum phase shift value (beam spot position adjustment amount) by fixing the write clock frequency, and also has a function of comparing the phase shift value calculated with a preset threshold. The controller 250' transmits a write clock setting signal and a control signal for executing the phase shift to the write clock generator 58 at a predetermined timing, respectively.

That is, in the third embodiment, the controller 250' functions as the phase adjustment amount-determining unit. The controller 250' also functions as the frequency modulator (main position correcting unit) together with the PLL transmitter 58*a*, and as the phase modulator (sub position correcting unit) together with the phase controller 58*b*.

In FIG. 5, the write clock generator 58 and the time difference measuring unit 57 are shown as separate units; however, they can be combined into one write clock generator.

The controller 250' in the third embodiment starts the routine of magnification correction of an image shown in FIG. 6 at a predetermined timing.

That is, at first step S21, the controller 250' sets a write clock initial value and a phase shift initial value in the write clock generator 58, at a predetermined timing such as after turning the power on or restarting after having stopped the machine, and makes the optical scanner printable corresponding to the set write clock initial value and phase shift initial value. In this state, since the printing is possible, printing can be performed.

At next step S22, at the timing when the polygon mirror 32 is rotating between sheets or during printing, and when the laser diode 29 is in the state capable of lighting, the controller 250' outputs an instruction to calculate a magnification adjustment value to the time difference measuring unit 57.

At step S23, the controller 250' allows the time difference measuring unit 57 to measure the time difference since the sensor 25 has detected the laser beam at specified timing until the sensor 26 detects the laser beam, for the specified number of measurements. The controller 250' inputs the measurement result to calculate a mean value or the like of the measurement result.

At next step S24, a phase shift value (beam spot position adjustment amount) when the write clock frequency is fixed is calculated from the mean value or the like of the measurement result of the time difference. At step S25', the controller 250' determines the magnitude correlation between the phase shift value (beam spot position adjustment amount) calculated for each of the four developing colors at step S24 and the threshold preset in the controller 250'. That is, the controller 250' determines whether the phase shift value is larger than the threshold for each of the image writing units corresponding to the developing colors, to further determine whether the phase shift value is larger than the threshold in at least one of the determinations corresponding to the four developing colors, and stores the comparison result (magnitude correlation) in the storage unit.

According to the determinations corresponding to the four developing colors, when the phase shift value is larger than the threshold in at least one of the determinations, control proceeds to step S27. When all the phase shift values corresponding to the four developing colors do not exceed respective thresholds (phase shift value≦threshold) (NO), at step S26, the controller 250' transmits a control signal for performing the magnification correction of the image based on the phase shift value determined to the write clock generator 58, so as to perform magnification correction of the image by changing the cycle time of an optional pixel in the unit of pixel. That is, the magnification correction of the image is performed by the sub position correcting unit that performs magnification correction of the image by changing the beam spot position interval on the scanning line in the unit of pixel.

According to the determination at step S25', when the phase shift value of at least one of the four developing colors is larger than the threshold, and the phase shift value exceeds the threshold, control proceeds to step S27, where a write clock value and a phase shift value when an optimum write clock frequency is set is calculated from the measurement and calculation results at step S23. That is, the write clock frequency and the phase shift value (beam spot position adjustment amount) when executing the frequency modulation are calculated. The frequency modulation is executed in such a manner that magnification correction of an image (magnification correction of an image by the main position correcting unit) is performed by changing the beam spot position interval on the scanning line in the unit of a line or in the unit of a plurality of lines.

At next step S28, a control signal for performing magnification correction of an image based on the write clock frequency and the phase shift value calculated at step S27 is transmitted to the write clock generator 58, and at step S29, a control signal for performing magnification correction of an image based on the write clock frequency and the phase shift value calculated at step S27 is transmitted to the write clock generator 58. Accordingly, magnification correction of the image (magnification correction of an image by the main position correcting unit) is performed by changing the beam spot position interval on the scanning line in the unit of a line or in the unit of a plurality of lines.

In the case of the magnification correction by the frequency modulation, since the write clock is changed, magnification correction cannot be performed at any timing during image formation. Further, since a certain period of time is necessary for the processing of the magnification correction, it is necessary to have an interval between sheets during continuous printing. Accordingly, continuous printing is temporarily suspended, and the control signal is sent to the write clock generator 58 at a convenient timing.

At next step S30, printing is executed at the write clock frequency, with the write clock frequency changed according to the control signal set and transmitted to the write clock generator 58 at step S26, or the control signal set and transmitted to the write clock generator 58 at step S29.

At step S31, it is determined whether the all set image formation has finished, and if the image formation has finished, the processing in this routine is finished. However, if all image formation has not finished yet, control returns to step S22, to repeat the processing and determination at step S22 and following steps at a predetermined timing.

The first embodiment to the third embodiment indicate respective examples, each in which it is determined whether the phase shift value (beam spot position adjustment amount) calculated for each of the four developing colors exceeds the threshold, and in which when the phase shift value exceeds the threshold in at least one of four determination results, the main position correcting unit performs magnification correction. However, determination of a timing of changing over to the magnification correction by the main position correcting unit may be performed when the phase shift values exceed the respective thresholds in determination results corresponding to a plurality (the number can be arbitrarily set) of developing colors.

Alternatively, when a total amount obtained by adding up all of the four phase shift values (beam spot position adjustment amounts) corresponding to the four developing colors exceeds a corresponding threshold, the magnification correction may be performed by the main position correcting unit.

Figure 7:
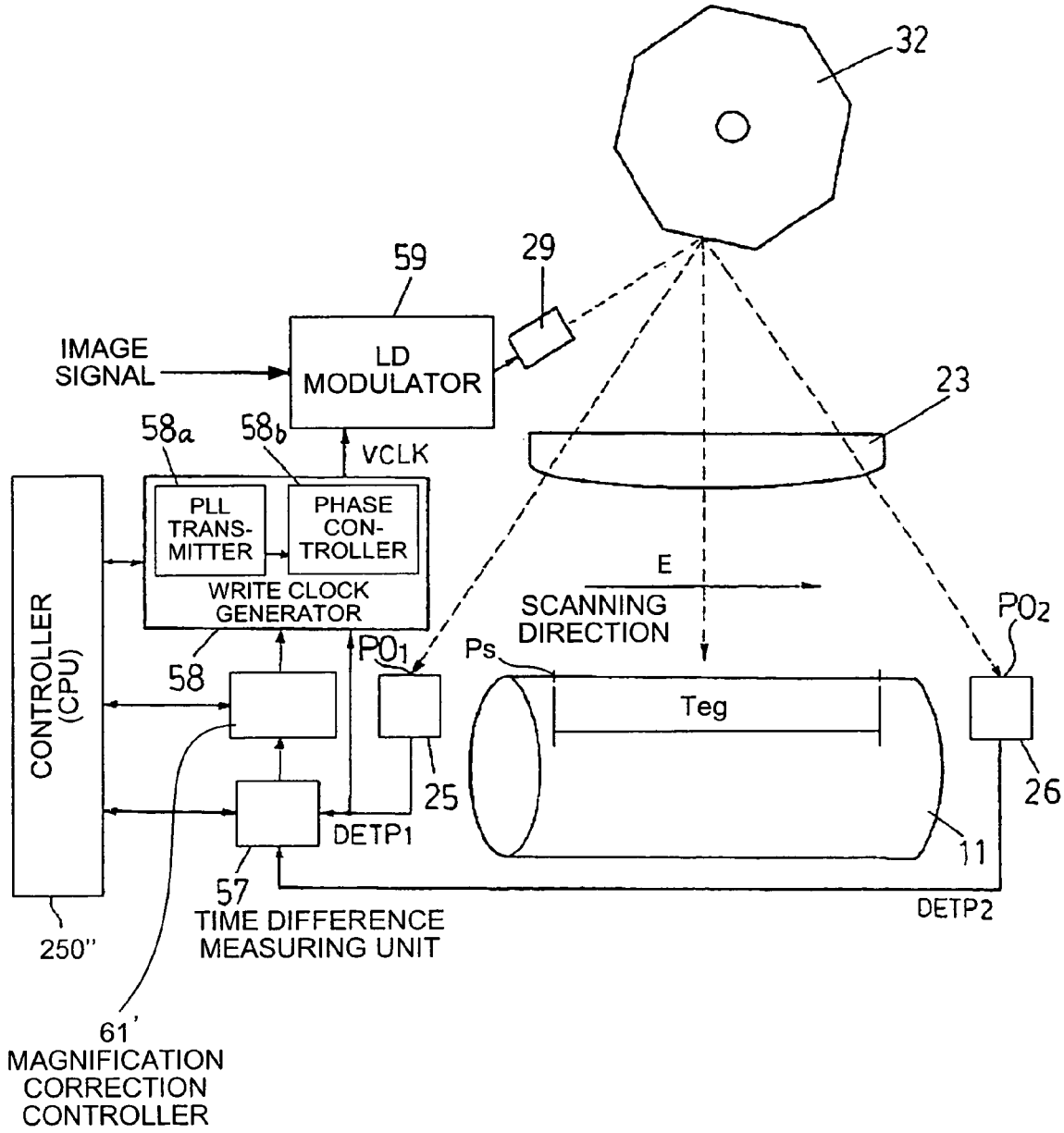
FIG. 7 is a schematic diagram of relevant parts of an optical scanner and a photoconductor together with an associated control system of an image forming apparatus according to a fourth embodiment of the present invention.
Figure 8:
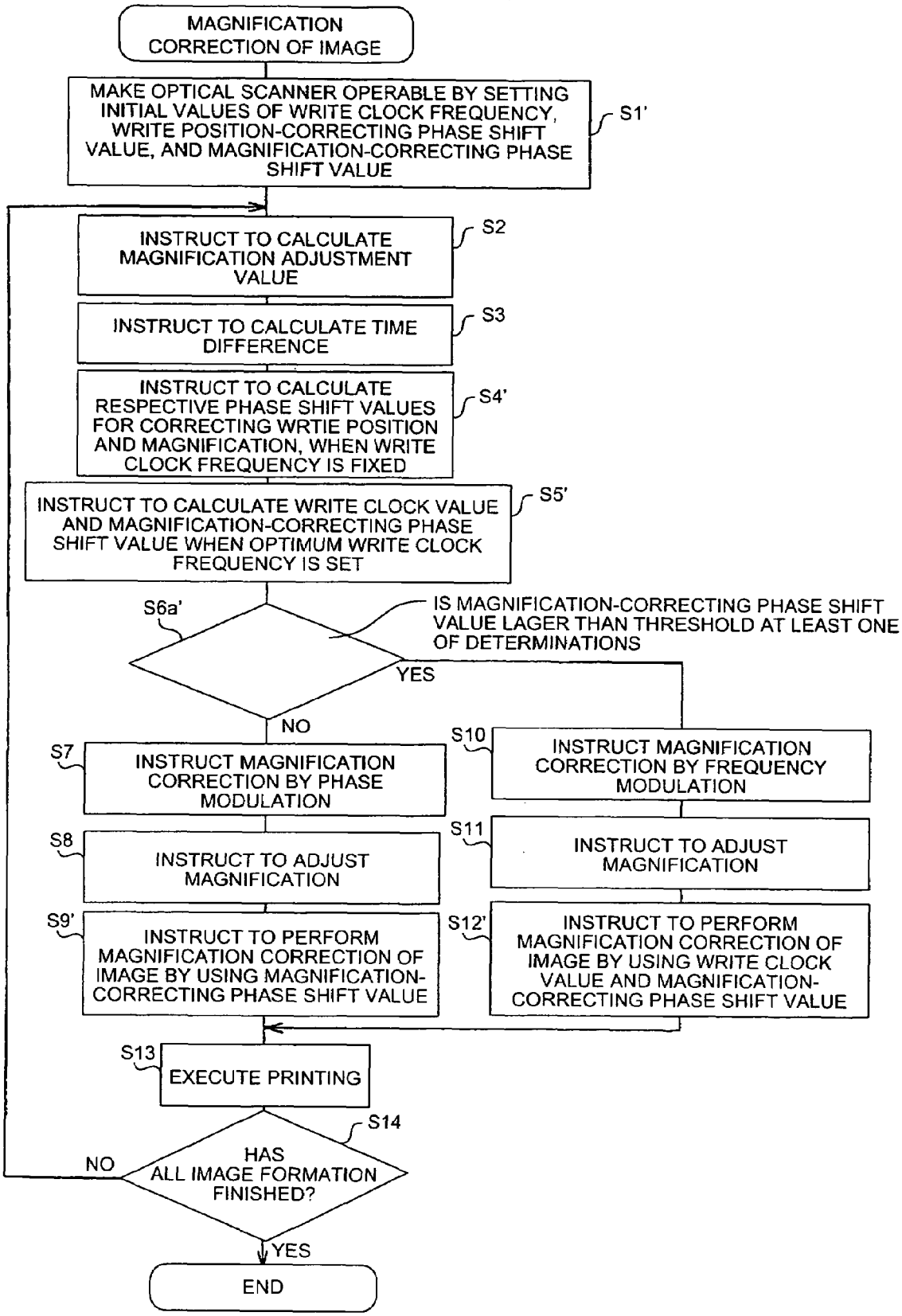
FIG. 8 is a flowchart of a process procedure for a magnification correction of an image performed by the control system in the image forming apparatus according to the fourth embodiment.

FIG. 7 is a schematic diagram of relevant parts of an optical scanner and a photoconductor together with an associated control system of an image forming apparatus according to a fourth embodiment of the present invention; and FIG. 8 is a flowchart of a process procedure for a magnification correction of an image performed by the control system. In FIG. 7, the parts that are similar to those shown in FIG. 1 have been designated with like reference signs. In FIG. 8, the steps that are similar to those shown in FIG. 3 have been designated with like step numbers.

The configuration of the image forming apparatus according to the fourth embodiment is the same as that in FIG. 2.

The image forming apparatus according to the fourth embodiment is different from the image forming apparatus explained with reference to FIG. 1 and FIG. 3 in that a write start position Ps in the horizontal scanning direction shown in FIG. 7 can be corrected by a write start position-correcting phase adjustment amount (write start position-beam spot position adjustment amount, hereinafter, as write position-correcting phase shift value), and magnification in the horizontal scanning direction can be also corrected by a magnification-correcting phase adjustment amount in the horizontal scanning direction (beam spot position adjustment amount in the horizontal scanning direction, hereinafter, as magnification-correcting phase shift value), and that magnitude correlation between the magnification-correcting phase shift value and a set threshold is then determined for each of the image writing units corresponding to the developing colors. When the magnification-correcting phase shift value exceeds the threshold in at least one of four determination results, magnification correction of an image (magnification correction of an image by the main position correcting unit) is performed by changing the beam spot position interval on the scanning line in the unit of a line or in the unit of a plurality of lines.

When all the four determination results are in the respective thresholds, the magnification correction of the image (magnification correction of the image by the sub position correcting unit) is performed by changing the beam spot position interval (changing the phase shift amount) on the scanning line in the unit of pixel.

Thus, in the configuration in which optimum phase adjustment (phase shift) is performed by changing the cycle time of an optional pixel per unit of pixel, that is, when correction of the optimum write start position Ps in the horizontal scanning direction and correction of the magnification in the horizontal scanning direction are respectively performed based on the write position-correcting phase shift value and the magnification-correcting phase shift value calculated by fixing the write clock frequency, the magnification correction controller 61' has a storage unit that stores initial set values of the write clock frequency, the write position-correcting phase shift value in the horizontal scanning direction, and of the magnification-correcting phase shift value, transmitted from a controller (CPU) 250", as well as the current set values thereof.

The controller (CPU) 250" is a microcomputer and it starts the routine for a magnification correction of an image shown in FIG. 8 at a predetermined timing, such as after turning the power on or restarting after having stopped the machine.

At first step S1', the controller 250" sets an initial value of the write clock frequency, an initial value of the write position-correcting phase shift value (write position-correcting phase shift initial value), and an initial value of the magnification-correcting phase shift value (magnification-correcting phase shift initial value) in the magnification correction controller 61', at a predetermined timing such as after turning the power on or restarting after having stopped the machine, and makes the optical scanner printable corresponding to the set initial value of the write clock frequency and phase shift initial values. In this state, since the printing is possible, printing can be performed.

At steps S2 and S3, the same processing as those explained at the steps S2 and S3 shown in FIG. 3 is performed. At step S4', the magnification correction controller 61' calculates the write position-correcting phase shift value (write start position-beam spot position adjustment amount) in the horizontal scanning direction and the magnification-correcting phase shift value (beam spot position adjustment amount in the horizontal scanning direction) when the write clock frequency is fixed, from a mean value or the like of the measurement result of the time difference since the sensor 25 has detected the laser beam until the sensor 26 detects the laser beam.

At step S5', the magnification correction controller 61' calculates a write clock value (frequency) and a magnification-correcting phase shift value when an optimum write clock frequency is set, corresponding to each of the developing colors, from the mean value or the like of the measurement result of the time difference.

At next step S6*a*', the controller 250" determines the magnitude correlation between the magnification-correcting phase shift value calculated at step S4' and a threshold preset in the controller 250", that is, whether the magnification-correcting phase shift value is larger than the threshold for each of the image writing units. The controller 250" further determines whether the magnification-correcting phase shift value is larger than the threshold in at least one of the determinations corresponding to the four developing colors, and stores the comparison result (magnitude correlation) in the storage unit.

According to the determination, when all the magnification-correcting phase shift values corresponding to the four developing colors are equal to or smaller than the respective thresholds, that is, when the magnification-correcting phase shift values do not exceed the thresholds (NO), the same processing and determination as those in FIG. 3 are performed at step S7 and following steps, to perform magnification correction of an image (magnification correction of an image by the sub position correcting unit) by phase modulation, with the frequency fixed. At this time, in the fourth embodiment, at step S9', magnification correction in the horizontal scanning direction is performed only by using the magnification-correcting phase shift value.

According to the determination at step S6*a*', when the magnification-correcting phase shift value is larger than the threshold in at least one of the determinations corresponding to the four developing colors, that is, the magnification-correcting phase shift value exceeds the threshold, the same processing and determination as those in FIG. 3 are performed at step S10 and following steps, to perform magnification correction of the image (magnification correction of the image by the main position correcting unit) by frequency modulation, in which magnification correction of the image is performed by changing the frequency of an image signal to an optimum write clock frequency in the unit of a line or in the unit of a plurality of lines.

Thus, in the fourth embodiment, the phase adjustment amount (phase shift) at the time of fixing the write clock frequency is divided into the write position-correcting phase shift value for correcting the write start position and the magnification-correcting phase shift value for correcting the magnification in the horizontal scanning direction. Only the magnification-correcting phase shift value is compared with the threshold to determine the magnitude correlation therebetween, and magnification correction of the image by phase modulation and magnification correction of the image by frequency modulation are changed over according to the determination result. Even when the changeover of the image magnification correction method is determined based on only the magnification-correcting phase shift value, no problem will occur because the write position-correcting phase shift value affects little on image degradation in the image area.

Magnification correction of the image by the frequency modulation, in which the image forming operation needs to be suspended temporarily, is executed only when the magnification-correcting phase shift value exceeds the threshold. Therefore, the number of executing the magnification correction of the image by the frequency modulation can be reduced, thereby improving the overall print speed (productivity of image formation) accordingly, as the whole image forming apparatus.

As a fifth embodiment of the present invention that is a modification of the fourth embodiment, the magnification correction controller 61' shown in FIG. 7 may not be provided in the same manner as in the third embodiment explained with reference to FIG. 5.

In this case, the time difference measuring unit 57 shown in FIG. 7 performs time difference measurement and calculation between the laser beam detection signals DETP1 and DETP2, and transmits the measurement result and calculation result to the controller 250".

The controller 250" has a configuration including a storage unit that stores respective initial set values and current set values of the write clock frequency, the magnification-correcting phase shift value, and the write position-correcting phase shift value.

Further, the controller 250" has a function of calculating an optimum write clock frequency, and a magnification-correcting phase shift value and a write position-correcting phase shift value at the optimum frequency, a function of calculating an optimum magnification-correcting phase shift value by fixing the write clock frequency, and a function of comparing the magnification-correcting phase shift value calculated with a preset threshold, and transmits a write clock setting signal and a control signal for performing phase shift to the write clock generator 58 at a predetermined timing, respectively.

Figure 9:
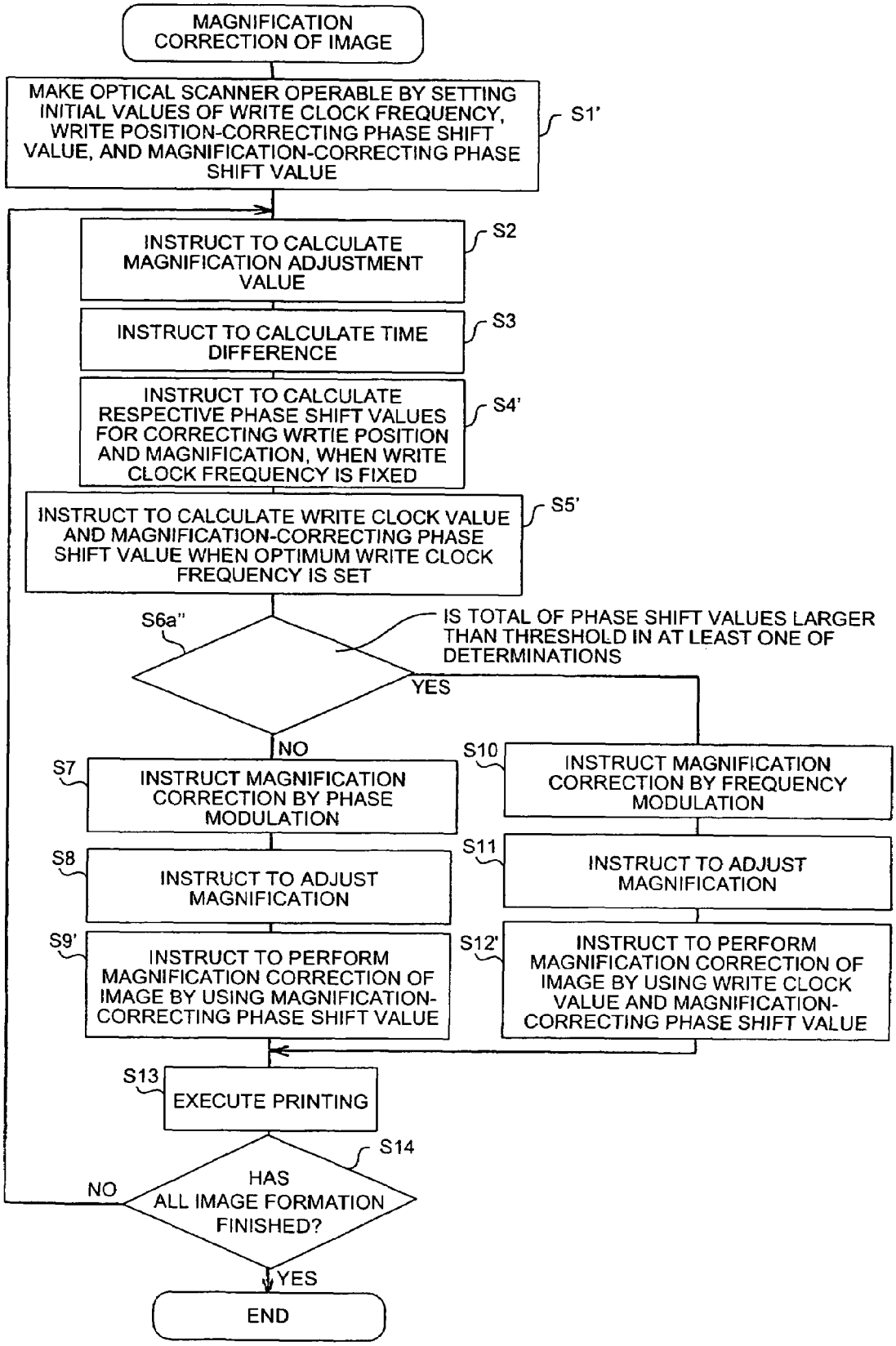
FIG. 9 is a flowchart of a process procedure for a magnification correction of an image performed by a control system in an image forming apparatus according to a sixth embodiment of the present invention.

FIG. 9 is a flowchart of a process procedure for a magnification correction of an image performed by a control system in an image forming apparatus according to a sixth embodiment of the present invention. For the brevity of explanation, in FIG. 9, the steps that are similar to those shown in FIG. 8 have been designated with like step numbers.

The configuration of the image forming apparatus according to the sixth embodiment is the same as that in FIG. 2. The control system is the same as that of the fourth embodiment explained with reference to FIG. 7 (or may be configured as shown in FIG. 5), and only the content of the control performed by the control system is different. Therefore, illustration of the control system is omitted as well, and as required, explanation is given by using the reference signs used in FIG. 7.

The phase modulator in the image forming apparatus according to the sixth embodiment can correct the write start position in the horizontal scanning direction by a write position-correcting phase shift value (write start position-correcting phase adjustment amount), and the magnification in the horizontal scanning direction by a magnification-correcting phase shift value (magnification-correcting phase adjustment amount in the horizontal scanning direction), respectively, as in the fourth embodiment explained with reference to FIG. 7 and FIG. 8.

In the sixth embodiment, a phase adjustment amount-determining unit (corresponding to the magnification correction controller 61' in FIG. 7) determines the magnitude correlation between a phase shift value (beam spot position adjustment amount) and a set threshold. The phase shift value is obtained by adding up the write position-correcting phase shift value and the magnification-correcting phase shift value (similar to those explained in the fourth embodiment) respectively corresponding to each of the four developing colors. Based on the determination results, until the phase adjustment amount exceeds the threshold in at least one of the determinations corresponding to the four developing colors, magnification correction of an image in the horizontal scanning direction is performed by phase modulation (magnification correction of an image by the sub position correcting unit) in which the write clock frequency is fixed, and after the phase adjustment amount exceeds the threshold, magnification correction of an image in the horizontal scanning direction is performed by frequency modulation (magnification correction of an image by the main position correcting unit), in which the write clock frequency is changed to an optimum value.

That it, when the routine in FIG. 9 is started, at the first step, the controller (the same microcomputer as the controller 250" in FIG. 7) of the image forming apparatus according to the sixth embodiment performs the same processing as at step S1' in FIG. 8, to set a write clock initial value, a write position-correcting phase shift initial value, and a magnification-correcting phase shift initial value, thereby making the optical scanner printable according to the set write clock initial value and the phase shift initial values.

At steps S2 and S3, the controller performs the same processing as those at steps S2 and S3 in FIG. 8, and at step S4', calculates a write position-correcting phase shift value in the horizontal scanning direction when the write clock frequency is fixed and a magnification-correcting phase shift value, from a mean value or the like of the measurement result of the time difference since the sensor 25 has detected the laser beam until the sensor 26 detects the laser beam, as in the fourth embodiment.

At step S5', the magnification correction controller 61' calculates a write clock value (frequency) and a magnification-correcting phase shift value when an optimum write clock frequency is set, from the mean value or the like of the measurement result of the time difference.

At next step S6*a*", the controller 250" determines the magnitude correlation between a phase adjustment amount, obtained by adding up the write position-correcting phase shift value and the magnification-correcting phase shift value when the write clock frequency calculated at step S4' is fixed, and a threshold preset in the controller 250". That is, the controller 250" determines whether the total of the magnification-correcting phase shift values is larger than the threshold, for each of the image writing units corresponding to the developing colors. The controller 250" further determines based on the determinations whether the magnification-correcting phase shift value is larger than the threshold in at least one of the determinations corresponding to the four developing colors, and stores the determination result (magnitude correlation) in the storage unit.

According to the determinations, when the total of the magnification-correcting phase shift values corresponding to the four developing colors is equal to or smaller than the threshold, that is, when the total of the phase shift values does not exceed the threshold for all the image writing units corresponding to the four developing colors (NO), the same processing and determination as those in FIG. 8 are performed at step S7 and following steps, to perform magnification correction of an image by phase modulation (magnification correction of an image by the sub position correcting unit), with the frequency fixed. At this time, in the sixth embodiment, at step S9', the magnification correction in the horizontal scanning direction is performed using only the magnification-correcting phase shift value.

According to the determination at step S6*a*", when the total of the magnification-correcting phase shift values is larger than the threshold in at least one of the determinations corresponding to the four developing colors, that is, the total of the magnification-correcting phase shift values exceeds the threshold, the same processing and determination as those in FIG. 8 are performed at step S10 and following steps, to perform magnification correction of the image by frequency modulation (magnification correction of an image by the main position correcting unit), in which magnification correction is performed by changing the frequency of an image signal to an optimum write clock frequency in the unit of a line or in the unit of a plurality of lines.

Thus, in the sixth embodiment, magnification correction of an image (magnification correction of an image by the sub position correcting unit) by phase modulation (frequency fixed) and magnification correction of the image by frequency modulation (magnification correction of the image by the main position correcting unit) are changed over, according to whether the phase shift value exceeds the preset threshold, the phase shift value being obtained by adding up the write position-correcting phase shift value and the magnification-correcting phase shift value when the write clock frequency is fixed.

Therefore, as compared with the fourth embodiment explained with reference to FIG. 7 and FIG. 8, the phase adjustment amount (beam spot position adjustment amount) can be determined accurately. Accordingly, changeover to the magnification correction of an image (magnification correction of an image by the main position correcting unit) by frequency modulation can be performed with high accuracy, thereby enabling accurate prevention of image degradation.

The fourth embodiment to the sixth embodiment indicate respective examples, each in which it is determined whether the phase shift value (beam spot position adjustment amount) calculated for each of the four developing colors exceeds the threshold, and in which when the phase shift value exceeds the threshold in at least one of four determination results, the main position correcting unit performs magnification correction. However, determination of a timing of changing over to the magnification correction by the main position correcting unit may be performed when the phase shift values exceed the respective thresholds in the determination results corresponding to a plurality (the number can be arbitrarily set) of developing colors.

Alternatively, when a total amount obtained by adding up all of the four phase shift values (beam spot position adjustment amounts) corresponding to the four developing colors exceeds a corresponding threshold, the magnification correction may be performed by the main position correcting unit.

Figure 10A:
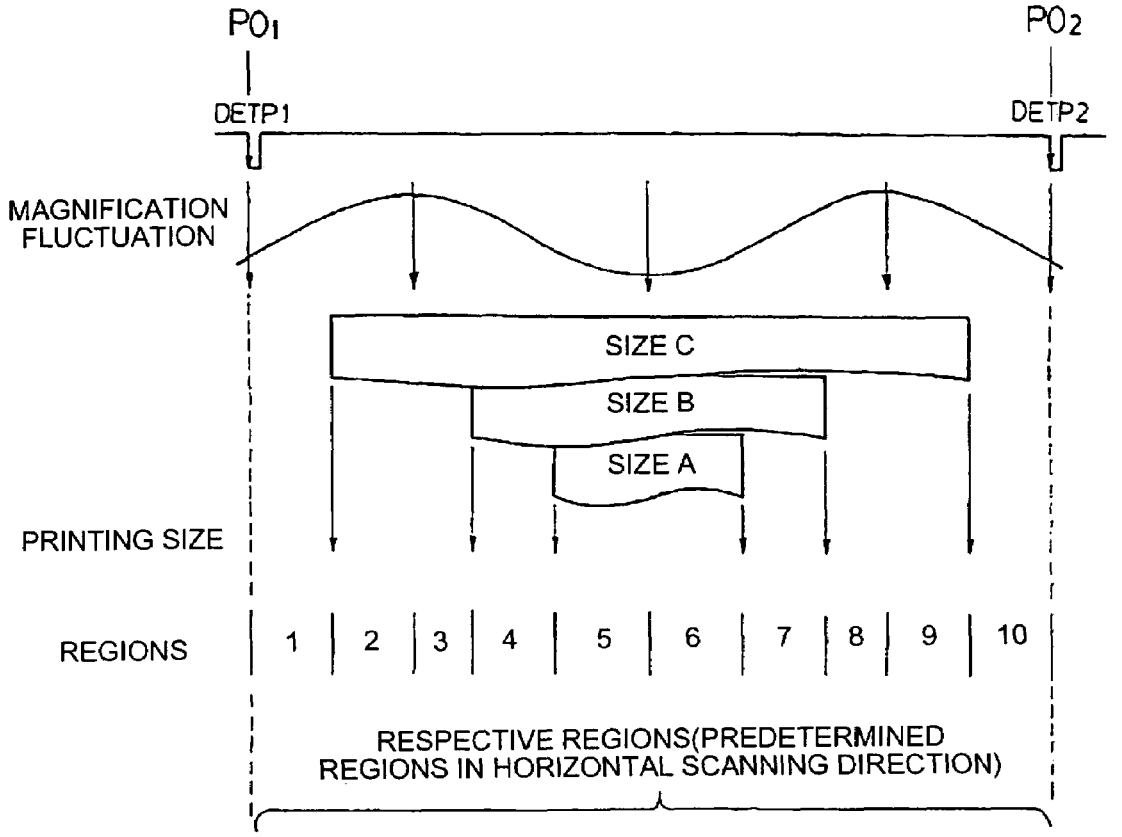
FIG. 10A and FIG. 10B are schematics for explaining of how the horizontal scanning direction is divided into regions by an image forming apparatus according to a seventh embodiment of the present invention.
Figure 10B:
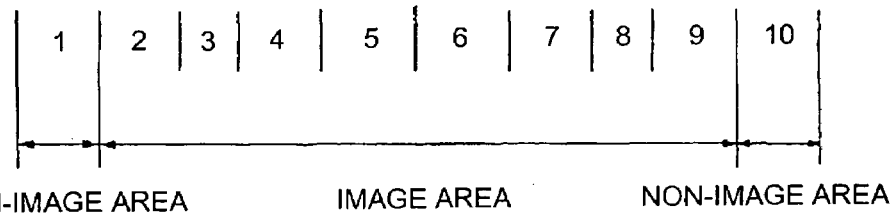
Figure 11:
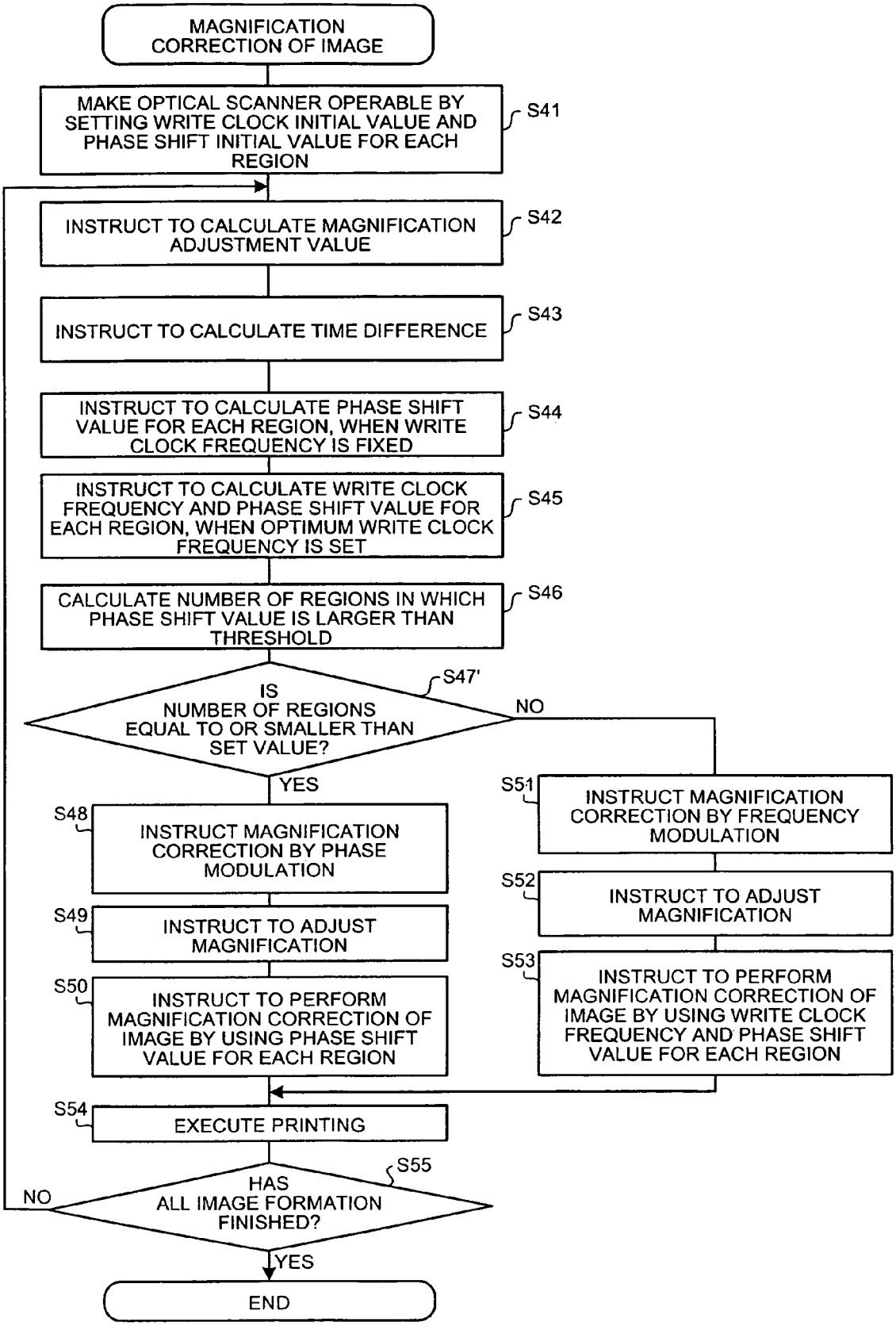
FIG. 11 is a flowchart of a process procedure for a magnification correction of an image performed by the control system in the image forming apparatus according to the seventh embodiment.

FIG. 10A and FIG. 10B are schematics for explaining how the horizontal scanning direction is divided into regions by an image forming apparatus according to a seventh embodiment of the present invention; and FIG. 11 is a flowchart of a process procedure for a magnification correction of an image performed by a control system in the image forming apparatus according to the seventh embodiment.

The configuration of the image forming apparatus according to the seventh embodiment is the same as that in FIG. 2. Moreover, the control system is the same as that of the first embodiment explained with reference to FIG. 1 (or may be configured as shown in FIG. 5), and only the content of the control performed by the control system is different. Therefore, illustration of the control system is omitted as well, and as required, explanation is given by using the reference signs used in FIG. 1.

The image forming apparatus according to the seventh embodiment is different from that of the first embodiment explained with reference to FIG. 1 and FIG. 3 in that a phase adjustment amount-determining unit (the magnification correction controller 61 in FIG. 1) is provided, and that the phase adjustment amount-determining unit determines the magnitude correlation between a magnification-correcting phase shift value, which is a beam spot position adjustment amount in a predetermined region in the horizontal scanning direction set for each of the developing colors which is calculated by the sub position correcting unit (the phase controller 58*b* in FIG. 1), and a threshold set for each of the developing colors, and that, based on the determination results by the phase adjustment amount-determining unit, magnification correction of an image by the sub position correcting unit is changed over to magnification correction of an image by the main position correcting unit (the PLL transmitter 58*a* in FIG. 1).

In the seventh embodiment, the magnitude correlation between the magnification-correcting phase shift value corresponding to each of the developing colors and a set threshold is determined. When the magnification-correcting phase shift value is larger than the threshold in at least one of determination results corresponding to the four developing colors, the magnification correction of an image by the sub position correcting unit is changed over to the magnification correction of the image (magnification correction of an image by the main position correcting unit) by changing the beam spot position interval on the scanning line in the unit of a line or in the unit of a plurality of lines.

In the seventh embodiment, predetermined regions in the horizontal scanning direction, that is, the whole region between the detection positions $PO_1$ and $PO_2$ of the sensors 25 and 26, as shown in FIG. 10A (also see FIG. 1) is divided into a plurality of regions, i.e., ten (1 to 10) regions in the horizontal scanning direction for each of the four developing colors, corresponding to the magnification fluctuation characteristic of the fθ lens or a printing size width corresponding to an assumed transfer paper size. A phase shift value for each of the divided regions, that is, a phase shift value (beam spot position adjustment amount by the sub position correcting unit) in a predetermined region in the horizontal scanning direction, calculated respectively by fixing the write clock frequency, is set for each region as shown in Table 1.

Further, the magnification correction controller 61 and the controller 250 (see FIG. 1) set thresholds I to X (set for each of the four developing colors) corresponding to the regions as shown in Table 1, calculate phase shift values I to X, and store these values.

Determination of the magnitude correlation between the phase shift value and the threshold is performed in the following manner.

At first, comparison is made between the phase shift values I to X for the regions of the divided first to the tenth regions and corresponding thresholds I to X, for each of the image writing units corresponding to the four developing colors. The regions are then divided into a region in which the phase shift value is equal to or smaller than the threshold, and a region in which the phase shift value is larger than the threshold. If there is even one region, (it may be set when the number becomes equal to or larger than a preset plurality number), in which the phase shift value is larger than the threshold, magnification correction of an image is performed by frequency modulation (magnification correction of an image by the main position correcting unit) in which the magnification correction is performed by changing the frequency of an image signal to an optimum write clock frequency in the unit of a line or in the unit of a plurality of lines.

In FIG. 10A and FIG. 10B, there is shown an example in which predetermined regions in the horizontal scanning direction indicate a plurality of divided regions having an unequal width, corresponding to the magnification fluctuation characteristic of the fθ lens and the printing size width according to an assumed transfer paper size. However, the respective regions to be divided may be divided into regions having an equal width.

The image forming apparatus according to the seventh embodiment starts the routine of magnification correction of an image shown in FIG. 11, at a predetermined timing.

At first step S41, the controller 250 sets a write clock frequency initial value (hereinafter, simply as write clock initial value) and a phase shift initial value in the magnification correction controller 61, at a predetermined timing such as after turning the power on or restarting after having stopped the machine. At this time, the phase shift value of the whole region between the detection positions $PO_1$ and $PO_2$ (also see FIG. 1) is not set, but a phase shift initial value (beam spot position adjustment amount) is set for each divided region.

The optical scanner is made printable corresponding to the set write clock initial value and phase shift initial value.

At next step S42, the same processing as explained at step S2 in FIG. 3 is performed, to issue an instruction to calculate a magnification adjustment value. At step S43, the same processing as explained at step S3 in FIG. 3 is performed, to perform measurement of the time difference since the sensor 25 has detected the laser beam until the sensor 26 detects the laser beam for a specified number of times, so that a mean value or the like of the measurement result is calculated.

At step S44, the phase shift value (beam spot position adjustment amount) is calculated for each region when the write clock frequency is fixed, from the mean value or the like of the measurement result of the time difference.

At step S45, substantially at the same timing as at step S44 in parallel, a write clock frequency (write clock value) when an optimum write clock frequency is set is calculated from the mean value or the like of the measurement result of the time difference. Further, the phase shift value (beam spot position adjustment amount) for each region when the frequency is changed to the optimum write clock frequency is calculated.

At step S46, the phase shift value (a value calculated by fixing the write clock frequency) is compared with each of the thresholds I to X (see Table 1) corresponding thereto for each region, to calculate the number of regions in which the phase shift value is larger than the threshold.

At step S47', it is determined whether the number of regions in which the phase shift value calculated is larger than the threshold is equal to or smaller than a preset value (0 is set in this example), and if the number is equal to or smaller than the preset value (Yes), control proceeds to steps S48 and S49, to transmit a determination result such that magnification correction of an image is to be executed by phase modulation (magnification correction of an image by the sub position correcting unit), which can perform magnification correction of the image without expanding the interval between sheets even during continuous printing, as in the processing explained at steps S7 and S8 in FIG. 3, to issue a magnification adjustment instruction.

At step S50, the controller 250 issues an instruction for performing magnification correction of an image with the respective phase shift values when the write clock frequency is fixed, calculated for respective regions. Accordingly, magnification correction of the image is performed by changing the cycle time of an optional pixel in the unit of pixel.

According to the determination at step S47', when control proceeds to step S51 since the number of regions in which the phase shift value is larger than the threshold is one or more and exceeds the preset value, the same processing as explained at steps S10 and S11 in FIG. 3 is performed at steps S51 and S52 to transmit a determination result such that magnification correction of an image (magnification correction of an image by the main position correcting unit) is to be executed by frequency modulation in which magnification correction of the image is performed by changing the write clock frequency (frequency of an image signal) in the unit of a line or in the unit of a plurality of lines, to issue a magnification adjustment instruction.

At step S53, the controller 250 issues an instruction for performing magnification correction of an image based on the optimum write clock frequency and the phase shift value for each region calculated at step S45. As a result, the magnification correction of an image is performed by frequency modulation, in which the frequency of an image signal is changed in the unit of a line or in the unit of a plurality of lines.

The processing and determination as those explained at step S13 and following steps in FIG. 3 are then performed at step S54 and following steps, and when the set all image formation has finished, the processing in this routine is finished.

Thus, in the seventh embodiment, it is determined whether a magnification-correcting phase shift value is larger than the threshold for each of predetermined regions (indicating any ones of the first to the tenth regions shown in FIG. 10A and FIG. 10B) in the horizontal scanning direction corresponding to each of the four developing colors. When the magnification-correcting phase shift value is larger than the threshold in at least one of determinations (two or more can be set), changeover is performed from the magnification correction of an image by phase modulation (magnification correction of an image by the sub position correcting unit) to magnification correction of an image by frequency modulation (magnification correction of the image by the main position correcting unit), in which magnification correction of an image is performed by changing the frequency of an image signal to an optimum write clock frequency in the unit of a line or in the unit of a plurality of lines.

FIG. 11 indicates an example in which the phase shift value for each region when the write clock frequency is fixed and the phase shift value for each region when an optimum write clock frequency is set are respectively calculated before determining whether the number of regions in which the phase shift value is larger than a threshold is equal to or smaller than the preset value. However, the calculation of the phase shift value for each region when the optimum write clock frequency is set is not performed at step S45 in FIG. 11, but only when the number of regions, in which the phase shift value is larger than the threshold, exceeds the preset value at step prior to step S51 and according to determination at step S47', the processing at step S45 may be performed.

The comparison between the phase shift value and the threshold can be performed in such a manner that, as shown in Table 2, a threshold obtained by unifying a plurality of divided regions is provided, which is then compared with a phase shift value obtained in the above manner. For example, even when the phase shift value is set for each region of from the first to the tenth regions, as in the example shown in Table 2, the respective regions are unified into a group (region) of from the second to the fourth regions, a group (region) of from the fifth to the sixth regions, and a group (region) of from the seventh to the ninth regions, and total values II, III, and IV of the phase shift values are respectively set corresponding to the groups, and these can be compared with the respective thresholds II, III, and IV.

Each group (region) is obtained by unifying a plurality of regions, and the number of groups in which the phase shift value exceeds the corresponding threshold is calculated. When the number exceeds a preset value, magnification correction of an image is performed by frequency modulation, which is performed by changing the write clock frequency.

In this case, the magnification correction controller 61 (or the controller 250' when applied to FIG. 5) has a function of calculating a phase shift value for each group shown in Table 2, and storing the calculation result. Further, the magnification correction controller 61 also includes a storage unit in which a threshold unified for each group can be set.

The way to unify the first to the tenth regions into a plurality of groups (regions) is not limited to the one shown in Table 2.

The predetermined regions in the horizontal scanning direction can be positioned in a horizontal-scanning image area, as the second to the ninth regions shown in FIG. 10B. The phase shift value (phase adjustment amount) in the image area can be then monitored, and hence, image degradation in the image area can be prevented.

Figure 12:
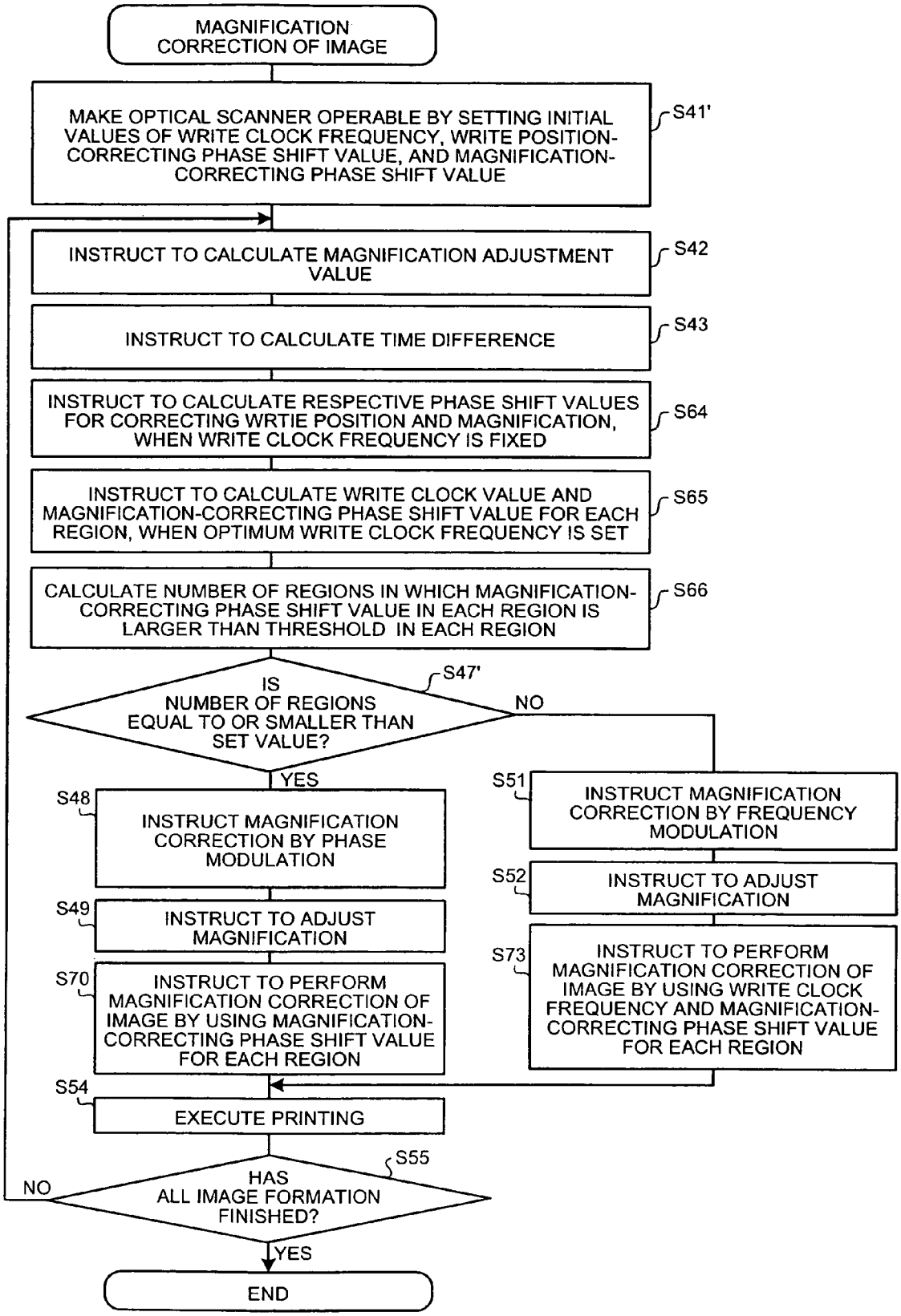
FIG. 12 is a flowchart of a process procedure for a magnification correction of an image performed by a control system in an image forming apparatus according to a eighth embodiment of the present invention.

FIG. 12 is a flowchart of a process procedure for a magnification correction of an image performed by a control system in an image forming apparatus according to a eighth embodiment of the present invention. For the brevity of explanation, in FIG. 12, the steps that are similar to those shown in FIG. 11 have been designated with like step numbers.

The configuration of the image forming apparatus according to the eighth embodiment is the same as that in FIG. 2. Moreover, the control system is also the same as that of the fourth embodiment explained with reference to FIG. 7 (or may be configured as shown in FIG. 5), and only the content of the control performed by the control system is different. Therefore, illustration of the control system is omitted as well, and as required, explanation is given by using the reference signs used in FIG. 7.

The phase modulator (sub position correcting unit) in the image forming apparatus according to the eighth embodiment can correct the write start position in the horizontal scanning direction by a write position-correcting phase shift value (write start position-beam spot position adjustment amount) by phase modulation, and correct the magnification in the horizontal scanning direction by a magnification-correcting phase shift value (beam spot position adjustment amount in the horizontal scanning direction) by phase modulation, respectively, as in the fourth embodiment explained with reference to FIG. 7 and FIG. 8. The position adjustment amount-determining unit (magnification correction controller 61' in FIG. 7) determines the magnitude correlation between a magnification-correcting phase shift value (beam spot position adjustment amount in the horizontal scanning direction) in a predetermined region in the horizontal scanning direction and a threshold set in the predetermined region.

When the routine in FIG. 12 is started, at first step S41', the controller (microcomputer similar to the controller 250" in FIG. 7) of the image forming apparatus according to the eighth embodiment performs the same processing as that at step S1' in FIG. 8, to perform the processing explained with reference to FIG. 11 at next steps S42 and S43.

At next step S64, a magnification-correcting phase shift value and a write position-correcting phase shift value, for each region (each predetermined region in 1 to 10 regions shown in FIG. 10A and FIG. 10B in the horizontal scanning direction) when the write clock frequency is fixed, are calculated (see Table 3).

At step S65, substantially at the same timing as at step S64 in parallel, a write clock frequency (write clock value) when an optimum write clock frequency is set is calculated. Further, a magnification-correcting phase shift value for each region when the frequency is changed to the optimum write clock frequency is calculated.

At next step S66, the magnification-correcting phase shift value (a value calculated by fixing the write clock frequency) for each region for each of the image writing units respectively corresponding to the four developing colors is compared with each of the thresholds I to X corresponding thereto for each region (see Table 3), to calculate the number of regions in which the magnification-correcting phase shift value in each region is larger than the threshold in the region.

At step S47', it is determined whether the number of regions calculated is equal to or smaller than a preset value (0 is set in this example, but a numerical value may also be set to 1 or more), and if the number is equal to or smaller than the preset value (YES), control proceeds to steps S48 and S49, to transmit a determination result such that magnification correction of an image (magnification correction of an image by the sub position correcting unit) is to be executed by phase modulation that can perform magnification correction of the image without expanding the interval between sheets even during continuous printing, as in the processing explained at steps S7 and S8 in FIG. 3, to issue a magnification adjustment instruction.

At step S70, the controller 250" issues an instruction for performing magnification correction of an image with the respective magnification-correcting phase shift values when the write clock frequency is fixed, calculated for respective regions. Accordingly, magnification correction of the image is performed by changing the cycle time of an optional pixel in the unit of pixel.

According to the determination at step S47', when control proceeds to step S51 since the number of regions in which the phase shift value is larger than the threshold is one or more and exceeds the preset value, the same processing as explained at steps. S10 and S11 in FIG. 3 is performed at steps S51 and S52, to transmit a determination result such that magnification correction of an image (magnification correction of an image by the main position correcting unit) is to be executed by frequency modulation in which magnification correction of the image is performed by changing the write clock frequency (frequency of an image signal) in the unit of a line or in the unit of a plurality of lines, to issue a magnification adjustment instruction.

At step S73, the controller 250" issues an instruction for performing magnification correction of an image based on the optimum write clock frequency and the magnification-correcting phase shift value for each region calculated at step S65. Accordingly, the magnification correction of the image is performed by frequency modulation, in which the frequency of an image signal is changed in the unit of a line or in the unit of a plurality of lines.

Thereafter, the same processing and determination as those explained at step S54 and following steps in FIG. 11 are performed, and when the set all image formation has finished, the processing in this routine is finished.

FIG. 12 indicates an example in which the magnification-correcting phase shift value and the write position-correcting phase shift value for each region when the write clock frequency is fixed, and the phase shift value for each region when an optimum write clock frequency is set are respectively calculated, before determining whether the number of regions in which the magnification-correcting phase shift value in each region is larger than the threshold in the region is equal to or smaller than the preset value. However, the calculation of the phase shift value for each region when the optimum write clock frequency is set is not performed at step S65 in FIG. 12, but may be performed at steps prior to step S51 and when the number of regions in which the phase shift value is larger than the threshold exceeds the preset value (NO) in the determination at step S47'.

According to the eighth embodiment, determination to change over the magnification correction of an image from the one by phase modulation (magnification correction of an image by the sub position correcting unit) to the one by frequency modulation (magnification correction of an image by the main position correcting unit) is performed by comparing only the magnification-correcting phase shift value (beam spot position adjustment amount in the horizontal scanning direction) with the threshold set in the predetermined region in the horizontal scanning direction. The write position-correcting phase shift value is not used for the comparison because it has little influence on image degradation in the image area. Accordingly, the content of the control can be simplified.

Figure 13:
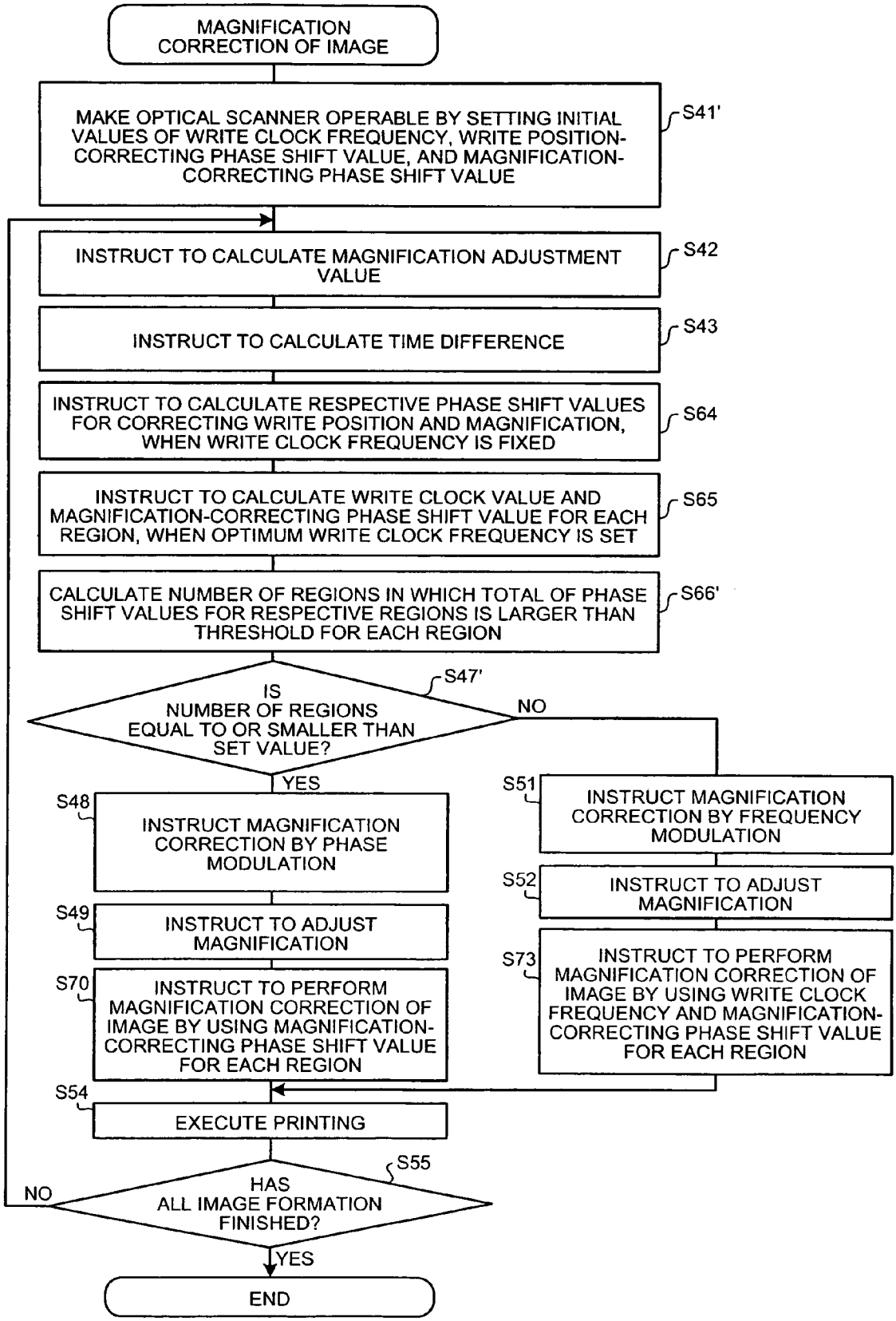
FIG. 13 is a flowchart of a process procedure for a magnification correction of an image performed by a control system in an image forming apparatus according to a ninth embodiment of the present invention.

FIG. 13 is a flowchart of a process procedure for a magnification correction of an image performed by a control system in an image forming apparatus according to a ninth embodiment of the present invention. For the brevity of explanation, in FIG. 13, the steps that are similar to those shown in FIG. 12 have been designated with like step numbers.

The configuration of the image forming apparatus according to the ninth embodiment is the same as that in FIG. 2. Moreover, the control system is the same as that of the fourth embodiment explained with reference to FIG. 7 (or may be configured as shown in FIG. 5), and only the content of the control performed by the control system is different.

The image forming apparatus according to the ninth embodiment is different from that of the eighth embodiment shown in FIG. 12 only in the following aspect. That is, the phase adjustment amount-determining unit determines the magnitude correlation between a phase adjustment amount and a set threshold, the phase adjustment amount being obtained by adding up a write position-correcting phase shift value (write start position-beam spot position adjustment amount) and a magnification-correcting phase shift value (beam spot position adjustment amount in the horizontal scanning direction) in a predetermined region in the horizontal scanning direction.

When the routine in FIG. 13 is started, at first step S41', the controller (a microcomputer similar to the controller 250" in FIG. 7) of the image forming apparatus according to the ninth embodiment performs the same processing as at steps S41' in FIG. 12, and thereafter, performs the same processing as at steps S42, S43, S64, and S65 in FIG. 12.

At step S66', comparison is made between a phase shift value (beam spot position adjustment amount) and each of thresholds I to X for each region, the phase shift value being obtained by adding up the write position-correcting phase shift value and the magnification-correcting phase shift value (a value calculated with the write clock frequency being fixed) calculated for each of 1 to 10 regions shown in Table 3. The number of regions, each in which the total of phase shift values in a region is larger than the threshold in the region, is then calculated.

Thereafter, the determination and processing at step S47' and following steps in FIG. 12 are performed. That is, it is determined whether the number of regions, each in which the total of phase shift values in a region calculated is larger than the threshold in the region, is equal to or smaller than a preset value (0 is set in this example, but a numerical value may be set to 1 or more). If the number is equal to or smaller than the preset value (YES), then magnification correction of an image (magnification correction of an image by the sub position correcting unit) is executed by phase modulation that can perform magnification correction of the image without expanding the interval between sheets even during continuous printing.

According to the determination at step S47', when the number of regions, in which the total of the phase shift values in each region is larger than the threshold in the relevant region, is 1 or more and exceeds the preset value, the magnification correction of an image (magnification correction of an image by the main position correcting unit) is executed by frequency modulation in which magnification correction of the image is performed by changing the write clock frequency (frequency of an image signal) in the unit of a line or in the unit of a plurality of lines.

The processing at step S65 in FIG. 13 may be performed between step S47 and step S51, rather than being performed immediately after step S64.

According to the ninth embodiment, determination to changeover the magnification correction of an image from the one by phase modulation to the one by frequency modulation is performed by comparing the phase shift value obtained by adding up the write position-correcting phase shift value and the magnification-correcting phase shift value with the threshold. Therefore, the phase shift amount in a region in which image degradation is desired to be prevented can be determined accurately.

According to the present invention, the magnitude correlation between the phase adjustment amount and the threshold is determined, and changeover to the magnification correction of an image by frequency modulation, at which image degradation does not occur, is performed based on the determination result. Therefore, the threshold is set to a value of allowable limit in image degradation, so that image degradation cannot occur. Since the number of suspending the image forming operation, due to magnification correction of an image by frequency modulation, can be reduced, a drop of the overall print speed (number of image formations per unit time) as an image forming apparatus can be prevented.

According to the image forming apparatus that includes the position adjustment amount-determining unit that determines the magnitude correlation between the beam spot position adjustment amount corresponding to each of a plurality of developing colors and the threshold set for each of the developing colors, the threshold can be optimized for each developing color. Therefore, changeover of magnification correction of an image can be performed from the one by the sub position correcting unit to the one by the main position correcting unit at more optimum timing. Therefore, productivity of image formation can be improved.

According to the present embodiments, the magnitude correlation between the phase shift value and the threshold is determined, and magnification correction of an image is changed over to the one by frequency modulation, in which image degradation does not occur, based on the determination result. Accordingly, degradation in an image can be prevented by setting the threshold to a value within a tolerance limit of image degradation. Further, the number of suspending the image forming operation, due to execution of the magnification correction of the image by frequency modulation, can be reduced, thereby preventing a drop in the overall sprint speed (number of image formations per unit time) as the image forming apparatus.

Further, according to the image forming apparatus including the frequency adjustment amount converter that converts the phase adjustment amount set by the phase modulator to the frequency adjustment amount for the frequency modulator, the phase adjustment amount set by the phase modulator is directly converted to the frequency adjustment amount for the frequency modulator without measurement of the amount or the like. Therefore, magnification correction of an image can be controlled only by calculation, without suspending continuous printing, thereby preventing a drop in sprint speed as the image forming apparatus.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a deflector configured to deflect optical beams modulated according to an image signal to thereby scan a surface of an image carrier in a horizontal scanning direction to form an image on the image carrier;

an optical beam detector arranged on either side of the image carrier along the horizontal scanning direction, wherein the optical beam detectors are configured to detect optical beams deflected by the deflector;

a time difference measuring unit configured to measure a time difference between detections of the optical beams by optical beam detectors; and a magnification correcting unit configured to correct, based on the time difference, a magnification in the horizontal scanning direction of the image on the image carrier, wherein the magnification correcting unit includes a main position correcting unit configured to perform magnification correction of the image by changing a beam spot position interval on a scanning line in units of a line or lines;

a sub position correcting unit configured to perform magnification correction of the image by changing a beam spot position interval on a scanning line in units of pixel; and a position adjustment amount-determining unit that determines whether a beam spot position adjustment amount corresponding to each of a plurality of developing colors preset by the sub position correcting unit exceeds a threshold preset for each of the plurality of developing colors, wherein the magnification correction of the image by the sub position correcting unit is changed over to the magnification correction of the image by the main position correcting unit based on a determination result of the position adjustment amount-determining unit.

2. The image forming apparatus according to claim 1, wherein the sub position correcting unit corrects a write start position in the horizontal scanning direction, and corrects a magnification in the horizontal scanning direction, the beam spot position adjustment amount includes a write start position-beam spot position adjustment amount used for correcting the write start position in the horizontal scanning direction, and a beam spot position adjustment amount in the horizontal scanning direction used for correcting the magnification in the horizontal scanning direction, and the position adjustment amount-determining unit determines whether the beam spot position adjustment amount in the horizontal scanning direction exceeds the threshold.

3. The image forming apparatus according to claim 1, wherein the sub position correcting unit corrects a write start position in the horizontal scanning direction, and corrects a magnification in the horizontal scanning direction, the beam spot position adjustment amount includes a write start position-beam spot position adjustment amount used for correcting the write start position in the horizontal scanning direction, and a beam spot position adjustment amount in the horizontal scanning direction used for correcting the magnification in the horizontal scanning direction, and the position adjustment amount-determining unit determines whether a phase adjustment amount exceeds the threshold, the phase adjustment amount being obtained by adding up the write start position-beam spot position adjustment amount and the beam spot position adjustment amount in the horizontal scanning direction.

4. An image forming apparatus comprising:

a deflector configured to deflect optical beams modulated according to an image signal to thereby scan a surface of an image carrier in a horizontal scanning direction to form an image on the image carrier;

an optical beam detector arranged on either side of the image carrier along the horizontal scanning direction, wherein the optical beam detectors are configured to detect optical beams deflected by the deflector;

a time difference measuring unit configured to measure a time difference between detections of the optical beams by optical beam detectors; and a magnification correcting unit configured to correct, based on the time difference, a magnification in the horizontal scanning direction of the image on the image carrier, wherein the magnification correcting unit includes a main position correcting unit configured to perform magnification correction of the image by changing a beam spot position interval on a scanning line in units of a line or lines;

a sub position correcting unit configured to perform magnification correction of the image by changing a beam spot position interval on a scanning line in units of pixel; and a position adjustment amount-determining unit that determines whether a beam spot position adjustment amount by the sub position correcting unit, in a predetermined region in the horizontal scanning direction set for each of a plurality of colors, exceeds a threshold preset for each of the colors, wherein the magnification correction of the image by the sub position correcting unit is changed over to the magnification correction of the image by the main position correcting unit based on a determination result of the position adjustment amount-determining unit.

5. The image forming apparatus according to claim 4, wherein the sub position correcting unit corrects a write start position in the horizontal scanning direction, and corrects a magnification in the horizontal scanning direction, the beam spot position adjustment amount includes a write start position-beam spot position adjustment amount used for correcting the write start position in the horizontal scanning direction, and a beam spot position adjustment amount in the horizontal scanning direction used for correcting the magnification in the horizontal scanning direction, and the position adjustment amount-determining unit determines whether the beam spot position adjustment amount in the horizontal scanning direction in the predetermined region exceeds the threshold in the predetermined region.

6. The image forming apparatus according to claim 4, wherein the sub position correcting unit corrects a write start position in the horizontal scanning direction, and corrects a magnification in the horizontal scanning direction, the beam spot position adjustment amount includes a write start position-beam spot position adjustment amount used for correcting the write start position in the horizontal scanning direction, and a beam spot position adjustment amount in the horizontal scanning direction used for correcting the magnification in the horizontal scanning direction, and the position adjustment amount-determining unit determines whether a phase adjustment amount exceeds the threshold, the phase adjustment amount being obtained by adding up the write start position-beam spot position adjustment amount and the beam spot position adjustment amount in the horizontal scanning direction.

* * * * *